United States Patent [19]

Nishijima

[11] Patent Number: 4,868,100

[45] Date of Patent: Sep. 19, 1989

[54] SILVER HALIDE PHOTOGRAPHIC LIGHT-SENSITIVE MATERIAL

[75] Inventor: Toyoki Nishijima, Odawara, Japan

[73] Assignee: Konica Corporation, Tokyo, Japan

[21] Appl. No.: 235,108

[22] Filed: Aug. 22, 1988

[30] Foreign Application Priority Data

Sep. 1, 1987 [JP] Japan ..... 62-218468

[51] Int. Cl.[4] ..... G03C 7/38; G03C 1/08

[52] U.S. Cl. ..... 430/550; 430/558; 430/569; 430/604

[58] Field of Search ..... 430/550, 558 R, 604, 430/569

[56] References Cited

U.S. PATENT DOCUMENTS

| | | | |
|---|---|---|---|
| 4,469,783 | 9/1984 | Kuwabara et al. | 430/569 |
| 4,548,899 | 10/1985 | Nakayama et al. | 430/558 |
| 4,695,533 | 9/1987 | Nakayama et al. | 430/558 |
| 4,705,747 | 11/1987 | Klotzer et al. | 430/550 |
| 4,746,603 | 5/1988 | Yamashita et al. | 430/569 |
| 4,791,052 | 12/1988 | Kida et al. | 430/558 |

*Primary Examiner*—Richard L. Schilling

*Attorney, Agent, or Firm*—Jordan B. Bierman

[57] ABSTRACT

A silver halide photographic light-sensitive material is disclosed, which is improved on color reproducibility, image stability and toe gradiation. The photographic material comprises a support having thereon at least one silver halide emulsion layer containing at least one coupler represented by the following Formula I and a water-soluble iridium salt in an amount of from $10^{-9}$ mol to $10^{-3}$ mol per mol of silver halide;

Formula I

Formula I

In Formula I, at least one of the groups represented by $R_1$, $R_2$, $R_3$ and $R_4$ contains at least one group represented by the following formula II;

Formula II $$-R_5-SO_2-R_6.$$

16 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide color photographic light-sensitive material which is excellent in color reproducibility and image preservability and improved in gradation especially in the toe portion of the characteristic curve thereof.

BACKGROUND OF THE INVENTION

It has been well known so far that a silver halide color photographic light-sensitive material is exposed imagewise to light and color-developed so as to couple the oxidized product of an aromatic primary amine color developing agent with a color forming agent and, thereby, a dye including, for example, indophenol, indoaniline, indamine, azomethine, phenoxazine, phenazine or the like is formed, so that a dye image can be formed.

The couplers for forming a yellow dye image include, for example, an acylacetanilide type coupler. The couplers for forming a magenta dye image include, for example, those of the pyrazolone type, pyrazolobenzimidazole type, pyrazolotriazole type or indazolone type. Further, the couplers for forming a cyan dye image include, for example, those of the phenol type or naphthol type.

Particularly, the couplers popularly used for forming magenta dye images include, for example, 1,2-pyrazolo-5-one couplers. The dyes formed of this type of couplers have a principal absorption in around 550 nm and, besides, a side absorption in around 430 nm. This type of couplers have had a serious problem from the viewpoint of color reproducibility, due to a color contamination caused by this side absorption of yellow component.

Further, in the case of the magenta couplers, yellow stains caused by light, heat and moisture in a color developed area are much more serious than in the cases of cyan and yellow couplers, so that the magenta couplers have had a defect in improving image preservability.

The particularly excellent magenta couplers, which have effectively improved the yellow stains as well as the above-mentioned side absorption being yellow component, include, for example, the couplers of the pyrazolotriazole type and the like types such as those described in U.S. Pat. No. 3,725,067, Japanese Patent Publication Open to Public Inspection (hereinafter referred to as Japanese Patent O.P.I. Publication) Nos. 99437-1984, 162548-1984 and 171956-1984, Research Disclosure Nos. 24220, 24230 and 24531, and so forth.

In the dyes formed of the magenta couplers such as those of the pyrazolotriazole type and so forth, the side absorption thereof around 430 nm is less by far than those of the dyes formed of the above-mentioned 1,2-pyrazolo 5-ones couplers. Therefore, they have excellent characteristics such as an excellent color reproducibility and very rare yellow stain produced by light, heat or moisture in the areas where no color is developed.

The dyes formed of the magenta couplers, such as those of the above-mentioned pyrazolotriazole type and so forth, have the excellent characteristics as mentioned above and they can satisfactorily display these excellent characteristics particularly when they are applied to color-print papers.

However, the dyes formed of the above-mentioned pyrazolotriazole type magenta couplers have had such a defect that the light-fastness thereof is relatively deteriorated.

Therefore, a variety of pyrazolotriazole type magenta couplers having a high light-fastness have been proposed. Among these proposals, the coupler proposed in Japanese Patent O.P.I. Publication No. 189537-1986 was found to be particularly excellent in light-fastness, that is, the coupler in which the carbon atom of a secondary or tertiary alkyl is bonded to the pyrazoloazole mother nucleus thereof.

It was, however, fount that this type of couplers have a defect that the gradation in the toe portion is softer than those of other pyrazolotriazole type couplers.

Therefore, when this type of couplers are applied to a color light-sensitive material, the gradation among the three layers, red-, green- and blue-light sensitive layers, become unbalanced and, in particular, magenta color is liable to be loud in high-light portions. In a light-sensitive material for color print, therefore, the so-called pink highlight phenomenon occurs, for example, sky or cloud becomes pinkish and snow does not come out in white but in pink. Human eye discriminates such a delicate phenomenal variation as mentioned above particularly in a low density to judge that a color print is not well-finished due to the phenomenon.

Accordingly, when designing a color light-sensitive material, much efforts have been directed to balance the gradation among the three layers particularly in their low density portions.

The gradation in the toe portion is softened by the pyrazolotriazole type coupler bonded to the above-mentioned carbon atom of secondary of tertiary alkyl. This phenomenon seriously degrades the commercial value of a light-sensitive material with the tendency of a pink highlight occurrence. It is not too much to say that this phenomenon leads the light-sensitive material to a fatal defect.

There have so far been varieous studies on the methods for controlling the gradation of silver halide photographic light-sensitive materials.

The methods which have been generally used include, for example, a method of suitably varying both the amounts of silver halides and couplers to be coated and the quantitative proportion of the silver halides to the couplers; the methods of making a mixture of two or more kinds of silver halide emulsions which are different from each other both in grains sizes and sensitization processes, of which are described in, for example, Japanese Patent O.P.I. Publication Nos. 71320-1975, 44016-1978, 78831-1981, 58137-1982, 150841-1982, 178235-1982, 14829-1983, and so forth; a method in which the conditions, additives and so forth are so selected as to harden the gradation in the toe portion when silver halide grains are chemically sensitized or color sensitized; a method in which a water-soluble rhodium salt is added in the process of forming silver halide grains described in, for example, Japanese Patent O.P.I. Nos. 11029-1977, 18310/1977, British Pat. No. 1535016 U.S. Pat. No. 3,448,709; and so forth. In these methods, however, there may be some instances where not only the toe portion is purposively hardened but also the gradation in the shoulder portion is hardened, where the gradation may be softened in long preservation, or where other photographic characteristics such as sensitivity, fogginess, exposure characteristics and so forth may be affected. Therefore, in the state of things, no effective technology was found out of the conventional technologies to harden only the gradation in toe portion but not to affect other characteristics.

Particularly, among the above-mentioned hardening methods applied to a pyrazolotriazole type coupler to which the carbon atom of the aforementioned secondary or tertiary alkyl is bonded, a method capable of displaying a substantial hardening effect in the toe portion has a tendency of deteriorating light resistance, while a method capable of reducing the deterioration of light resistance has a tendency of displaying a little hardening effect. It has not been easy to achieve both of the deterioration prevention of light resistance and the hardening effect in toe portion.

After the inventors have continued to try to solve the above-mentioned problems, they have discovered a method in which both of the light resistance and the gradation in toe portion can particularly be excellent by combining a specific hardening agent with a coupler having a specific structure selected from the pyrazoloazole type couplers to which the carbon atom of secondary or tertiary alkyl is bonded, so that they have achieved this invention.

SUMMARY OF THE INVENTION

It is an object of the invention to provide a silver halide photographic light-sensitive material improved in color reproducibility.

Another object of the invention is to provide a silver halide photographic light-sensitive material which is hard in gradation in the toe portion thereof, excellent in light resistance and improved in color reproducibility.

The above-mentioned objects of the invention can be achieved with a silver halide photographic light-sensitive material comprising a support bearing thereon at least one silver halide emulsion layer containing a silver halide and a coupler, wherein the above-mentioned silver halide emulsion layer contains at least one coupler represented by the following formula I and a water-soluble iridium salt in an amount of from $10^{-9}$ mol to $10^{-3}$ mol per mol of silver used.

Formula I

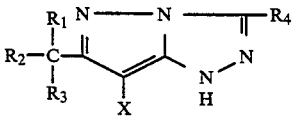

Formula I wherein X represents a halogen atom or a monovalent organic group capable of being split off upon coupling reaction with the oxidized product of a color developing agent; $R_1$, $R_2$ and $R_3$ may be the same with or different from each other and each represents a halogen atom or a group of alkyl, cycloalkyl, alkenyl, cycloalkenyl, alkinyl, aryl, hetrocyclic, acyl, sulfonyl, sulfinyl, phosphonyl, carbamoyl, sulfamoyl, cyano, spiro compound residue, bridged hydrocarbon compound residue, alkoxy, aryloxy, heterocyclic oxy, siloxy, acyloxy, carbamoyloxy, amino, acylamino, sulfonamido, imido, ureido, sulfamoylamino, alkoxycarbonylamino, aryloxycarbonylamino, alkoxycarbonyl, alkylthio, aryloxycarbonyl, arylthio or heterocyclic thio; and $R_4$ represents a hydrogen atom or a group of alkyl, aryl, heterocyclic, acylamino, alkylamino, anilino, alkoxycarbonyl or alkylthio; provided that at least one of $R_1$, $R_2$, $R_3$ and $R_4$ contains at least one group represented by the following formula II.

Formula II $$-R_5-SO_2-R_6$$

wherein $R_5$ represents a substituted or non-substituted alkylene or arylene group; and $R_6$ represents a substituted or non-substituted alkyl or aryl group.

DETAILED DESCRIPTION OF THE INVENTION

Now, the invention will be described further in detail.

The couplers applicable to the invention are represented by the following formula I.

Formula I

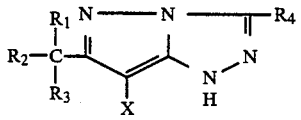

Formula I wherein X represents a halogen atom or a monovalent organic group capable of being split off upon coupling reaction with the oxidized product of a color developing agent; $R_1$ through $R_3$ may be the same with or different from each other and each represents a halogen atom such as those of chlorine, bromine, fluorine and so forth; an alkyl group such as those having 1 to 32 carbon atoms and being allowed to have a straight-chained or branched, and, to be more concrete, the alkyl groups include, for example, a group of methyl, propyl, t-butyl, hexadecyl, 3-(3-pentadecylphenoxy)-propyl, 3-(2,4-di-tert- amylphenoxy)propyl, 3-(2,4-di-tert-amylphenoxy)ethyl, 3-(4-di-tert amylphenoxy)propyl and 2-[α(3-tert-butyl-4-hydroxyphenoxy)tetradecanamidoethyl]; a cycloalkyl group such as a cyclohexyl group; an alkenyl group such as a propenyl group; a cycloalkenyl group; an alkinyl group; an aryl group such as a group of phenyl, α- or β-naphthyl, 4-methylphenyl, 2,4,6-trichlorophenyl and 4-[α-(3-tert-butyl-4-hydroxyphenoxy)tetradecanamido]-2,6-dichlorophenyl; a heterocyclic group such as a group of pyridyl, thienyl and quinolyl; an acyl group such as a group of acetyl and benzoyl; a sulfonyl group; a sulfinyl group; a phosphonyl group such as a butyloctylphosphonyl group; a carbamoyl group; a sulfamoyl group; a cyano group; a spiro compound residual group such as a spiro (3,3) heptane-1 yl group; a bridged hydrocarbon compound residual group such as a bicyclo (2,2,1) heptane-1-yl; an alkoxy group such as a group of methoxy, ethoxy, propoxy and isopropoxy; an aryloxy group such as a phenoxy group; a heterocyclic oxy group such as a 1-phenyltetrazolyloxy group; a siloxy group such as a trimethylsiloxy group; an acyloxy group such as an acetyloxy group; a carbamoyloxy group; an amino group; an acylamino group such as a group of acetylamino and benzamido, 3-(2,4-di-tert-amylphenoxy)butylamido, 3-(3-pentadecylphenoxy)butylamido; a sulfonamido group such as a methanesulfonamido group; an imideo group such as a succinimido group; a ureido group; a sulfamoylamino group; an alkoxycarbonylamino group such as a group of methoxycarbonylamino and tetradecyloxycarbonylamino; an aryloxycarbonnylamino group such as a phenoxycarbonylamino group; an alkoxycarbonyl group such as a methoxycarbonyl group; an aryloxycarbonyl group such as a phenoxycarbonyl group; an alkylthio group such as a group of hexylthio and dodecylthio; an arylthio group such as a phenylthio group; or a heterocyclic thio group such as a 3-pyridylthio group; provided that at least two of $R_1$ through $R_3$ shall not be hydrogen atom; and $R_4$ represents a hydrogen atom; an alkyl group including those having 1 to 32 carbon atom and being allowed to have a straight-chained or branched substituent, and these alkyl groups include, typically, a group of methyl, propyl, t-butyl, hexadecyl, 3-(3-pentadecylphenoxy)propyl, 3-(2,4-di-tert-amylphenoxy)propyl, 3-dodecylsulfonyl)propyl, 2-(2,4-di-tert-amylphenoxy)ethyl, 2-(2,4-di-tert-amylphenoxy) propyl and 2-[α-(3-tert-butyl-4-hydroxyphenoxy)tetradecaneamidoethyl]; an aryl group such as a group of phenyl, α- or β-naphthyl, 4-methylphenyl, 2,4,6-trichlorophenyl, 4-[α-(3-tert-butyl-4-hydroxyphenoxy)tetradecanamido]-2,6-dichlorophenyl; a heterocyclic group such as a group of pyridyl, thienyl and quinilyl; an acylamino group such as a group of acetylamino, benzamido, 3-(2,4-di-tert-amylphenoxy)butylamido and 3-(3-pentadecylphenoxy)butylamido; an alkylamino group such as a group of methylamino, diethylamino and n-dodecylamino; an anilino group such as a group of phenylamino, 2-chloro-5-tetradecanamidophenylamino, 4-[α-(3-t-butyl-4-hydroxyphenoxy)tetradecanamido]anilino; an alkoxycarbonyl group such as a group of methoxycarbonyl, tetradecyloxycarbonyl; and an alkylthio group such as a group of hexylthio and dodecylthio; provided that at least one of $R_1$, $R_2$, $R_3$ and $R_4$ contain at least one of the groups represented by the following Formula II Formula II .

$$-R_5-SO_2-R_6$$

wherein $R_5$ represents a substituted or non-substituted alkylene group; and $R_6$ represents a substituted or non-substituted alkyl, cycloalkyl or aryl group.

The alkylene groups represented by $R_5$ are allowed to be either straight-chained or branched, however, the straight-chained portion should have preferably two or more carbon atoms and, more preferably, from 3 to 6 carbon atoms.

The cycloalkyl groups represented by $R_6$ should preferably have a 5- or 6-membered ring.

The typical examples of the couplers relating to the invention will be given below.

1

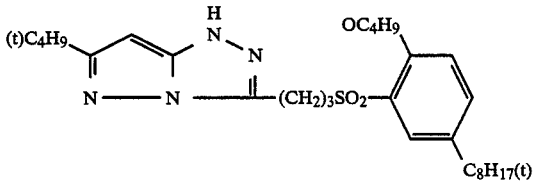

2

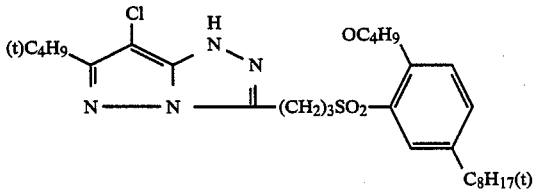

3

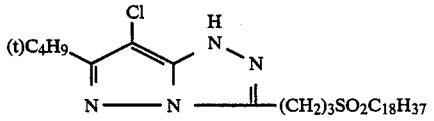

4

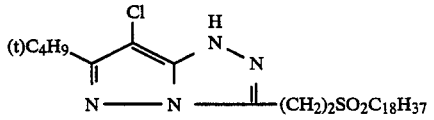

5

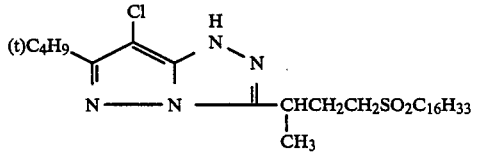

6

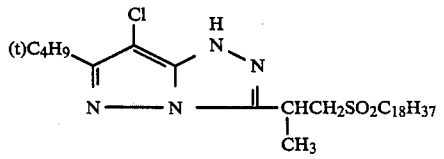

-continued
7
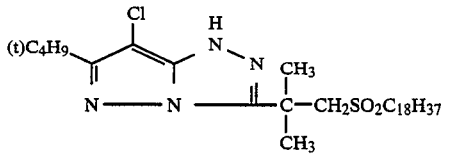
8
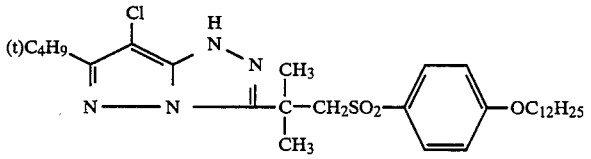
9
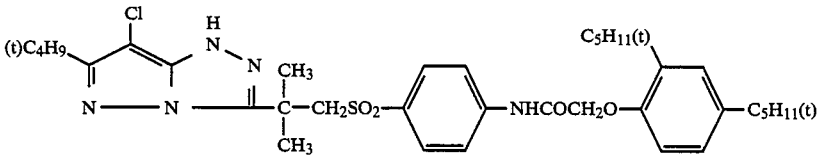
10
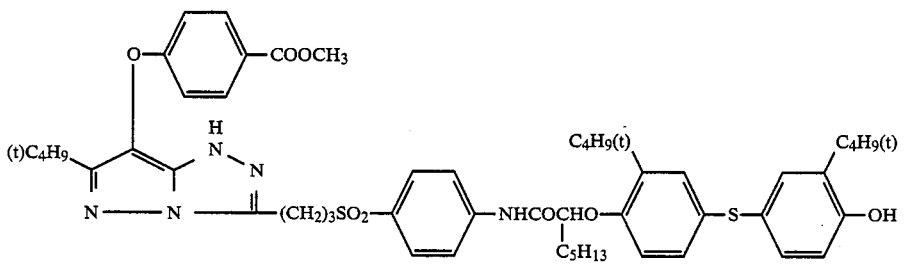
11
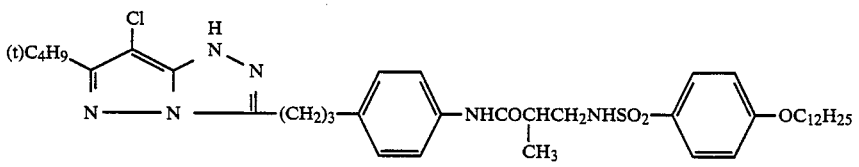
12
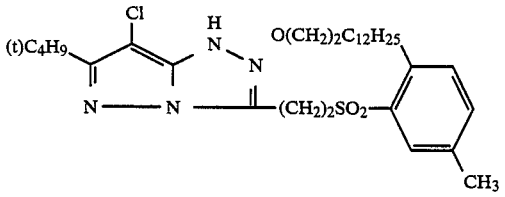
13
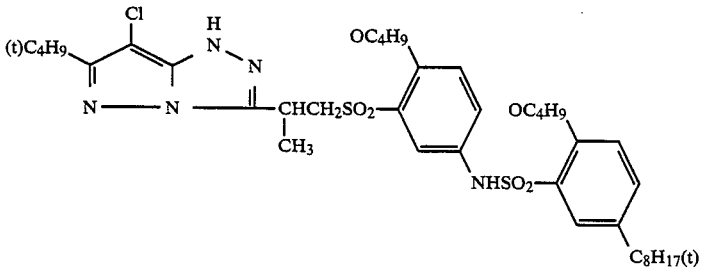

-continued

14

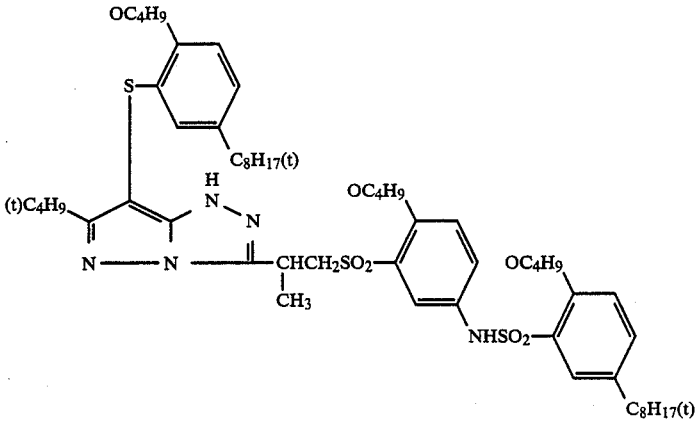

15

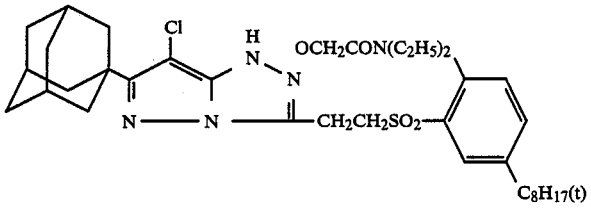

16

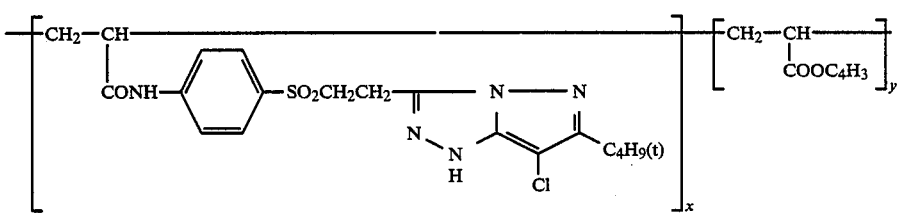

Besides the above-given typical examples of the compounds relating to the invention, the other typical compounds relating to the invention may be given as the examples, such as those compounds exemplified in Japanese Patent O.P.I. Publication No. 160339/1987 (corresponding to U.S. patent application Ser. No. 002,982), pp. 66–122, Nos. 104, 115, 120, 123 through 133, respectively.

These couplers may be synthesized with reference to Journal of the Chemical Society, Perkin I 1977, 2047–2052; U.S. Pat. No. 3,725,067; Japanese Patent O.P.I. Publication Nos. 99437-1984, 42045-1983, 162548–1984, 171956-1984, 33552–1985, 43659–1985, 172982-1985 and 190779-1985; and so forth.

The couplers of the invention may generally be used in an amount within the range of from $1\times10^{-3}$ mol to 1 mol and, preferably, from $1\times10^{-2}$ mol to $8\times10^{-1}$ mol per mol of a silver halide used. The couplers of the invention may also be used with the other kinds of magenta couplers in combination.

Next, in the invention, the gradation-hardening agents which may be used in combination with the aforementioned pyrazoloazole type couplers include, a water-soluble iridium compound. These compounds are used in the form of water-soluble salts such as, typically, a water-soluble iridium salt or a water-soluble iridium complex salt. To be more concrete, iridium trichloride, iridium tetrachloride, potassium hexachloroiridate (III), potassium hexachloroiridate (IV), ammonium hexachloroiridate (IV) and so forth may preferably be used.

An amount of the water-soluble iridium compound to be added into a silver halide grain is within the range of from $10^{-9}$ to $10^{-3}$ mol per mol of silver halide used and, preferably, from $10^{-8}$ to $10^{-5}$ mol. Within this range, an optimum amount added may suitably be selected by taking consideration of the grain sizes and crystal habits of silver halide grains and the combination use of sensitizing dyes and other additives. If such an iridium compound is added in an amount of less than $10^{-9}$ mol, the advantages of the invention cannot satisfactorily be expected. If it exceeds $10^{-3}$ mol, there may be some instance where other photographic characteristics may be affected by a desensitization, for example.

The water-soluble iridium compounds which are applicable to the invention may be added in any stages of nucleating growing and physical-ripening silver halide grains and these compounds may also be added by separating them into parts.

These water-soluble iridium compounds are used upon dissolving in water or a suitable solvent. It is also allowed to use a method which is usually applicable for stabilizing an iridium compound solution, that is, a method in which a hydrogen halide solution such as those of hydrochloric acid, hydrobromic acid, hydrofluoric acid and the like, or an alkali halide such as KCl, NaCl, NaBr and the like.

In the silver halide photographic light-sensitive materials of the invention containing the couplers represented by Formula I and the above-mentioned iridium compound, the gradation in the toe portion and the light resistance of a color image may be enhanced by adding the compounds represented by the following Formula III.

Formula III

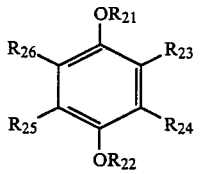

Formula III wherein $R_{21}$ and $R_{22}$ represent a hydrogen atom or a group of alkyl, alkenyl, aryl, acyl, cycloalkyl and heterocyclic; and, $R_{23}$, $R_{24}$, $R_{25}$ and $R_{26}$ represent a hydrogen atom, a halogen atom, or a group of alkyl, alkenyl, aryl, cycloalkyl, alkoxy, aryloxy, alkylthio, arylthio, acyl, alkylacylamino, arylacylamino, alkylcarbamoyl, arylcarbamoyl, alkylsulfonamido, arylsulfonamido, alkylsylfamoyl, arylsulfamoyl, alkylsulfonyl, arylsulfonyl, nitro, cyano, alkyloxycarbonyl, aryloxycarbonyl, alkylacyloxy and arylacyloxy, provided that, when $R_{23}$, $R_{24}$, $R_{25}$ and $R_{26}$ are hydrogen atoms at the same time, $R_{21}$ and $R_{22}$ shall not be hydrogen atoms at the same time.

Now, the gradient hardening agents represented by Formula III will be described below.

In the aforegiven Formula III, the alkyl groups represented by $R_{21}$ and $R_{22}$ include, for example, each group of methyl, ethyl, n-propyl, i-propyl, n-butyl, t-butyl, n-amyl, i-amyl, n-octyl, n-dodecyl, n-octadecyl and so forth. Among these alkyl groups, those having 1 to 32 carbon atoms should be preferable.

The alkenyl groups include, for example, each group of allyl, octenyl, oleyl and so forth. Among these alkenyl groups, those having 2 to 32 carbon atoms should be preferable.

The aryl groups include, for example, each group of phenyl, naphthyl and so forth.

The acyl groups include, for example, each group of acetyl, octanoyl, lauroyl and so forth.

The cycloalkyl groups include, for example, each group of cyclohexyl, cyclopentyl and so forth.

The heterocyclic groups include, for example, each group of imidazolyl, furyl, pyridyl, triazinyl, thiazolyl and so forth.

These groups include those having substituents. Such substituents include, for example, each group of alkyl, aryl, aryloxy, alkylthio, cyano, acyloxy, alkoxycarbonyl, acyl, sulfamoyl, hydroxy, nitro, amino, heterocyclic and so forth.

In the above-given Formula III, the halogen atoms represented by $R_{23}$, $R_{24}$, $R_{25}$ and $R_{26}$ include, for example, each atom of fluorine, chlorine and bromine. The alkyl groups include, for example, each group of methyl, ethyl, n-propyl, i-propyl, n-butyl, t-butyl, n-amyl, i-amyl, n-octyl, n-dodecyl, n-octadecyl and so forth. Among these alkyl groups, those having 1 to 32 carbon atoms should be preferable, in particular.

The alkenyl groups include, for example, each group of allyl, octenyl, oleyl and so forth. Among these alkenyl groups, those having 2 to 32 carbon atoms should be preferable, in particular.

The aryl groups include, for example, each group of phenyl, naphthyl and so forth.

The acyl groups include, for example, each group of acetyl, octanoyl, lauroyl and so forth.

The cycloalkyl groups include, for example, each group of cyclohexyl, cyclopentyl and so forth.

The alkoxy groups include, for example, each group of methoxy, ethoxy, dodecyloxy and so forth; the aryloxy groups include, for example, each group of phenoxy and so forth; the alkylthio groups include, for example, each group of methylthio, n-butylthio, n-dodecylthio and so forth; the arylthio groups include, for example, each group of phenylthio and so forth; the alkylacylamino groups include, for example, each group of acetylamino and so forth; the arylacylamino groups include, for example, each group of benzoylamino and so forth; the alkylcarbamoyl groups include, for example, each group of methylcarbamoyl and so forth; the arylcarmaboyl groups include, for example, each group of phenylcarbamoyl and so forth; the alkylsulfonamido groups include, for example, each group of methylsulfonamido and so forth; the arylsulfonamido groups include, for example, each group of phenylsulfonamido and so forth; the alkylsulfamoyl groups include, for example, each group of methylsulfamoyl and so forth; the arylsulfamoyl groups include, for example, each group of phenylsulfamoyl and so forth; the alkylsulfonyl groups include, for example, each group of methylsulfonyl and so forth; the arylsulfonyl groups include, for example, each group of phenylsulfonyl and so forth; the alkyloxycarbonyl groups include, for example, each group of methyloxycarbonyl and so forth; the aryloxycarbonyl groups include, for example, each group of phenyloxycarbonyl and so forth; the alkylacyloxy groups include, for example, each group of acetyloxy and so forth; and the arylacyloxy groups include, for example, each group of benzoyloxy and so forth.

The above-given groups include those having substituents. Such substituents include, for example, the same ones as those given to the groups represented by the $R_{21}$ and $R_{22}$.

Among the compounds which are applicable to the invention and represented by the aforegiven Formula III, the compounds represented by the following Formula III' should preferably be used in the invention.

Formula III'

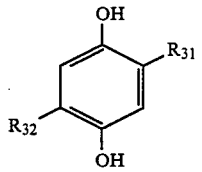

Formula III' wherein $R_{31}$ and $R_{32}$ each represent a hydrogen atom or a group of alkyl, alkenyl, aryl, acyl, cycloalkyl or heterocyclic, provided that the $R_{31}$ and $R_{32}$ should not be hydrogen atoms at the same time.

In the Formula III', the alkyl groups represented by $R_{31}$ and $R_{32}$ include, for example, each group of methyl, ethyl, n-propyl, i-propyl, n-butyl, t-butyl, n-amyl, i-amyl, n-octyl, n-dodecyl, n-octadecyl and so forth and, more preferably, an alkyl group having 1 to 32 carbon atoms.

The alkenyl groups include, for example, each group of ally, octenyl, oleyl and so forth and, more preferably, an alkenyl group having 2 to 32 carbon atoms.

The aryl groups include, for example, each group of phenyl, naphthyl and so forth.

The acyl groups include, for example, each group of acetyl, octanoyl, lauroyl and so forth.

The cycloalkyl groups include, for example, each group of cyclohexyl, cyclopentyl and so forth.

And, the heterocyclic groups include, for example, each group of imidazolyl, furyl, pirydyl, triazinyl, thiazolyl and so forth.

In the aforegiven Formula III', it should be more preferred that the total number of the atoms represented by $R_{31}$ and $R_{32}$ or that of the carbon atoms of each group represented thereby should be not less than eight, and that the groups should be those capable of providing non-diffusibility to the compounds having Formula III'.

The typical examples of the compounds which are applicable to the invention and represented by the aforegiven Formula III will be given below. It is, however, to be understood that the invention shall not be limited thereto.

HQ-1

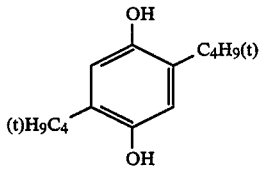

HQ-2

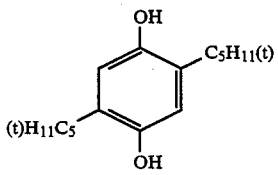

HQ-3

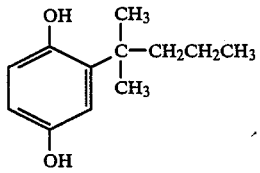

HQ-4

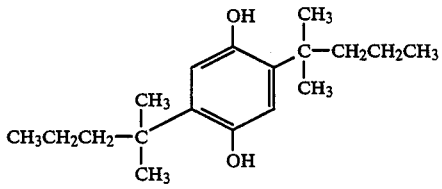

HQ-5

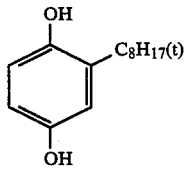

HQ-6

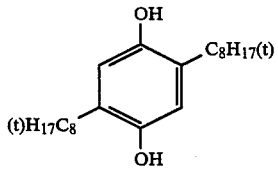

HQ-7

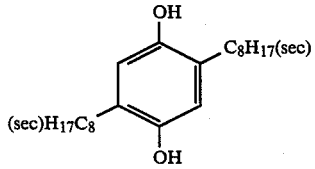

-continued
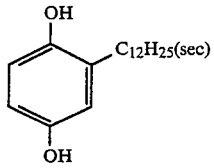
HQ-8
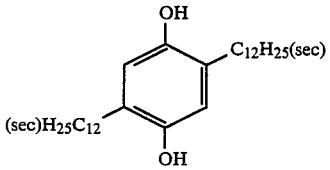
HQ-9
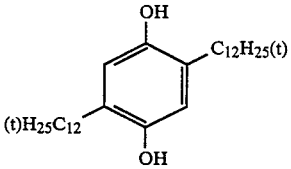
HQ-10
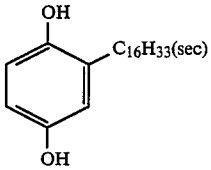
HQ-11
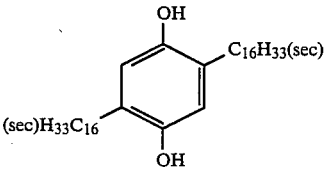
HQ-12
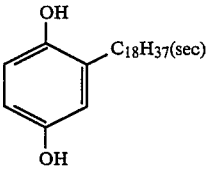
HQ-13
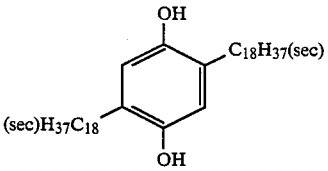
HQ-14
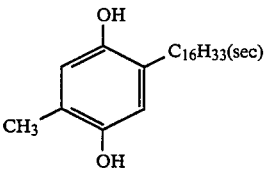
HQ-15
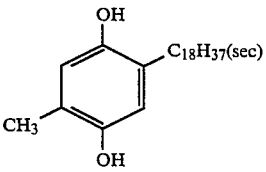
HQ-16

-continued
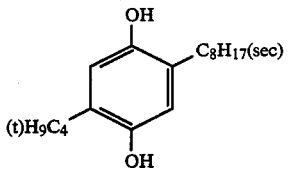
HQ-17
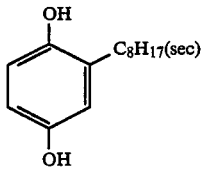
HQ-18
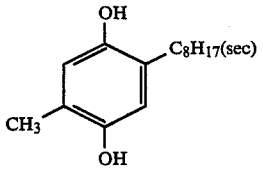
HQ-19
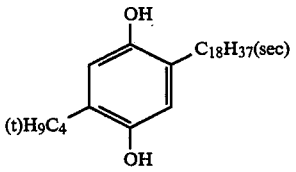
HQ-20
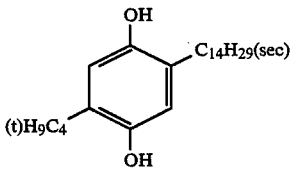
HQ-21
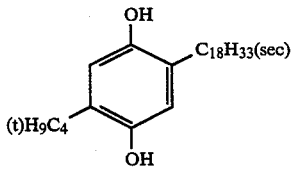
HQ-22
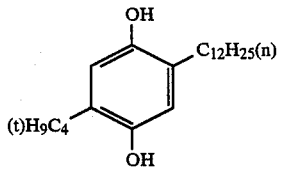
HQ-23
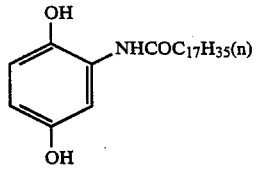
HQ-24
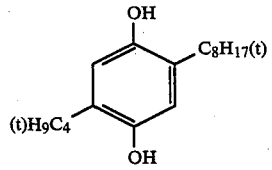
HQ-25

-continued

HQ-26

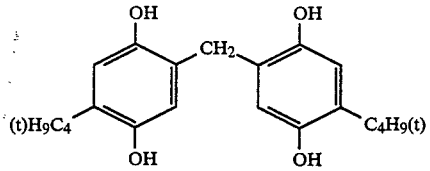

HQ-27

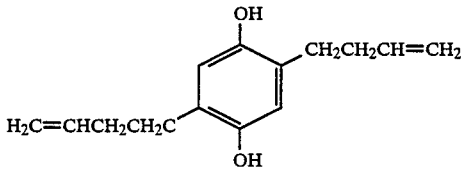

HQ-28

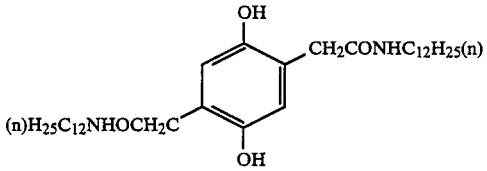

HQ-29

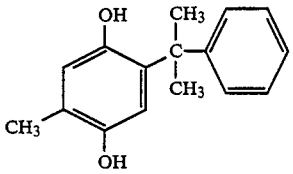

HQ-30

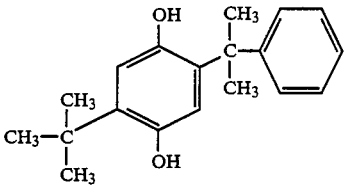

HQ-31

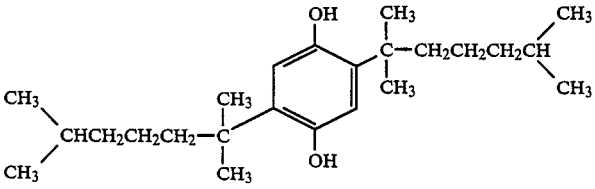

HQ-32

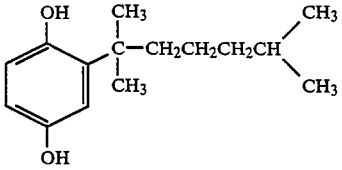

HQ-33

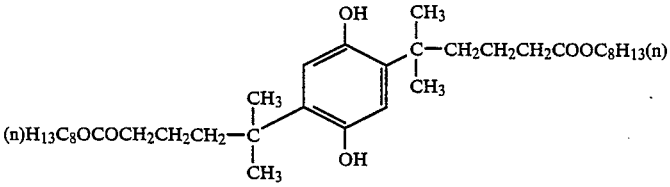

These compounds are described in, for example, Research Disclosure, No. 176, 1978, Article 17643, Paragraph VI-I.

The compounds which are applicable to the invention and represented by the aforegiven Formula III should be added in an amount of from 0.001 to 0.025 mol per mol of magenta couplers used and, preferably, from 0.005 to 0.02 mol.

Further, the silver halide photographic light-sensitive materials each containing both of the couplers of the invention and a water-soluble iridium salt may be improved in preservability in the state where they remain unused, by adding a water-soluble silver salt.

The water-soluble silver salt (hereinafter referred to as a water-soluble silver salt of the invention) is to be dissolved in water at 25° C. in an amount of not less than 1 g per one liter of water and preferably, in an amount of not less than 3 g. The above-mentioned water-soluble silver salts are allowed to be either inorganic or organic compounds.

The inorganic compounds of the water-soluble silver salts of the invention include, for example, silver nitrite, silver nitrate, silver chlorate, silver perchlorate, silver sulfate and so forth. The organic compounds thereof include, for example, silver acetate, silver caproate, silver propionate, silver butyrate, silver valerate, silver isovalerate, silver α-naphthoate and so forth.

Further, the water-soluble silver salts include a silver complex salts which may be dissolved, in water being kept at 25° C., in an amount of not less than 1 g and, more preferably, not less than 3 g per liter of water. The compounds which are used to produce these silver complex salts include, for example, ammonia, sodium thiosulfate, potassium cyanate and so forth. The complex ions to be used in the water-soluble silver salts of the invention include, for example, those of $[Ag(NH_3)_2]^+$, $[Ag(S_2O_3)_2]^{3-}$, $[Ag(S_2O_3)_3]^{5-}$, $[Ag(CN)_2]^-$, $[Ag(CN)_3]^{2-}$, $[Ag(SCN)_2]^-$, $[Ag(SCN)_4]^{3-}$, and so forth.

It is allowed to use any of the water-soluble silver salts of the invention of the inorganic and organic compounds, including the above-given silver complex salts. Taking the influence upon the photographic characteristics such as the increase in sensitivity, fogginess and so forth into consideration, it should be preferred to use the following compounds as the water-soluble silver salts, namely, the water-soluble silver salts capable of dissociating $Ag^+$ when they are dissolved in water, such as a compound selected from the group consisting of the aforegiven silver nitrite, silver nitrate, silver chlorate, silver perchlorate, silver sulfate, silver acetate, silver caproate, silver propionate, silver butyrate, silver valerate, silver isovalerate, silver α-naphthoate and so forth.

The water-soluble silver salts may be used independently or in combination.

The water-soluble silver salts may be added, in the solid form as they are, into a silver halide emulsion. It should, however, be preferable to add them in the form of a solution. As for the solvents used for this purpose, water is mainly used, however, if occasion demands, an organic solvent or a mixed solvent of a water-mixable organic solvent and water may also be used instead.

The water-soluble silver salts may be added into a silver halide emulsion at the point of time when preparing a coating solution of the silver halide emulsion or at any point of time between the time when completing the preparation of the coating solution and the time immediately before the coating is carried out.

The water-soluble silver salts should preferably be added into a silver halide emulsion at the point of time when the coating solution of the silver halide emulsion is prepared. To be more concrete, it is the point of time when the coating solution is prepared by mixing each of the following matters; a silver halide emulsion, a high boiling organic solvent capable of producing an oil solution about which will be described later, a hydrophobic compound such as a coupler which may be used if occasion demands and, besides, a coating aid including, for example, a liquid state physical property adjusting agent typified by spreading agents such as an anionic, cationic, nonionic or amphoteric surfactant, thickening agents such as a copolymer of an unsaturated monomer having such an active ester group as N-acryloyloxy succinimide and an unsaturated ethylene monomer, poly-(styrene-maleic anhydride), poly-(ethyl acrylate-maleic anhydride) and so forth. In this case, the water-soluble silver salts of the invention may be added at any point of time either immediately after every additive mentioned above is added or in the course of adding the same. The water-soluble silver salts of the invention may be added into an additive, provided that the additive is inert to any water-soluble silver salts. It is also allowed to put the water-soluble silver salt in advance in a vessel for preparing a coating solution and then a silver halide emulsion and additives are added therein.

Further, a water-soluble silver salt may be added after a coating solution is prepared. In other words, it may be added after every coating additive is added and then with the lapse of time.

The suitable amount of the water-soluble silver salts of the invention to be added depends on what kind of silver halide emulsion is used and so forth. Taking the influence on photographic characteristics such as sensitivity, fogginess and so forth into consideration, the amount added is within the range of from $5\times10^{-5}$ to 0.3 mol per mol of silver halide used and, more preferably, from $1\times10^{-4}$ to 0.1 mol.

In the magenta coupler-containing silver halide emulsion layer of the silver halide photographic light-sensitive materials of the invention, it should be preferred to use the phenol type antioxidizing agents represented by the following Formula IV.

Formula IV

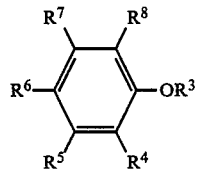

Formula IV wherein $R^3$ represents a hydrogen atom or a group of alkyl, alkenyl, aryl or heterocyclic; $R^4$, $R^5$, $R^7$ and $R^8$ each represent a hydrogen atom or a group of alkyl, alkenyl, aryl, alkoxy or acylamino; and $R^6$ represents a group of alkyl, hydroxy, aryl or alkoxy. $R^3$ and $R^4$ may be closed together to complete a 5- or 6-membered ring, provided that $R^6$ represents in this case a group of hydroxy or alkoxy. $R^3$ and $R^4$ may be closed together to complete a methylenedioxy ring. Further, $R^5$ and $R^6$ may be closed together to complete a 5-membered hydrocarbon ring, provided that $R^3$ represents in this case a group of alkyl, aryl or heterocyclic, except the case that $R^3$ represents a hydrogen atom and $R^6$ represents a hydroxy group.

The typical examples of the compounds which should preferably be used in the invention and represented by Formula IV will be given below.

PH-1
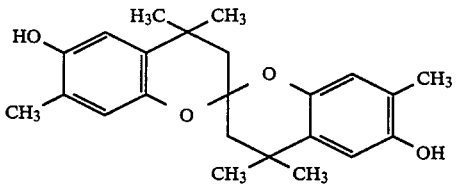
PH-2
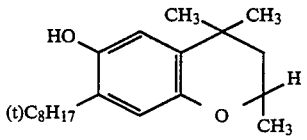
PH-3
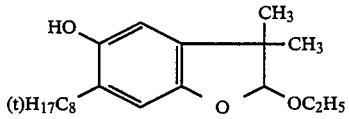
PH-4
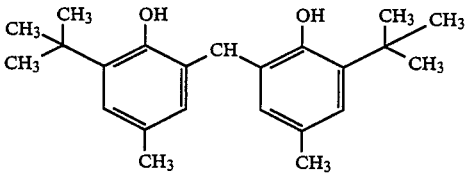
PH-5
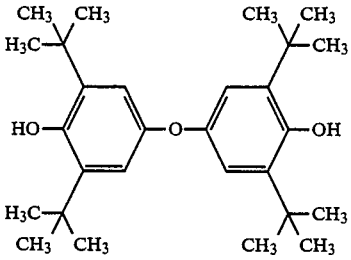
PH-6
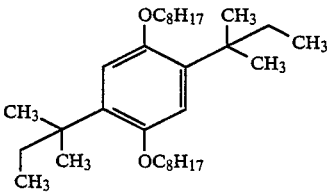
PH-7
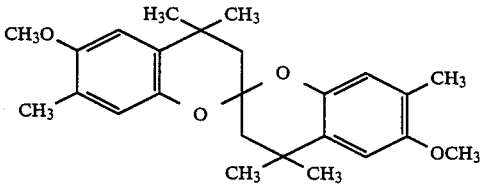
PH-8
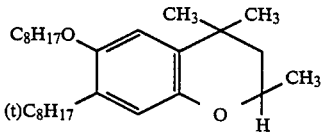
PH-9
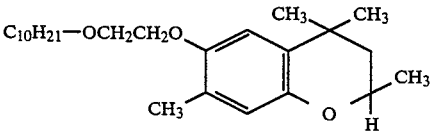
-continued
PH-10
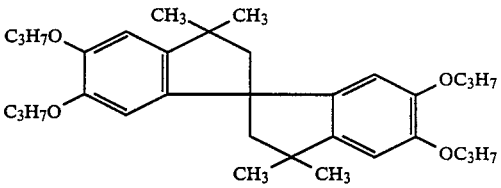
PH-11
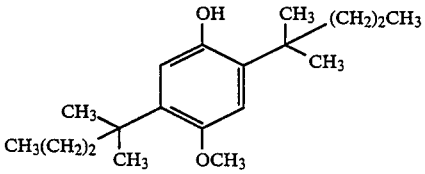
PH-12
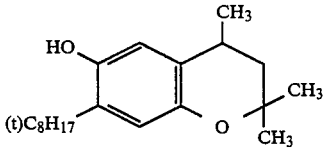
PH-13
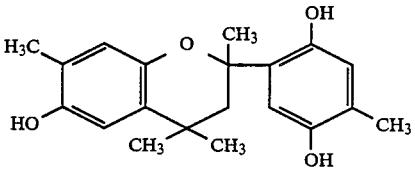
PH-14
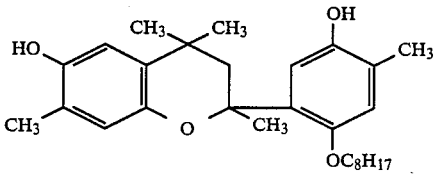
PH-15
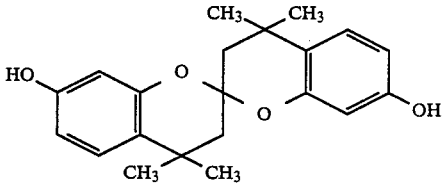
PH-16
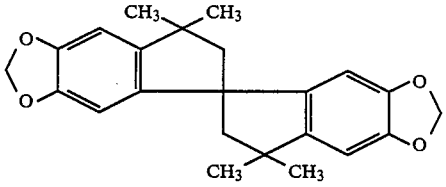
PH-17
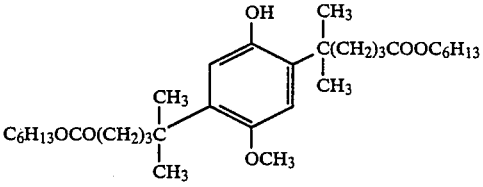
PH-18
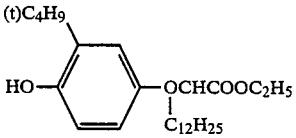

-continued

PH-19

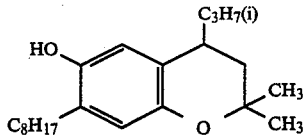

PH-20

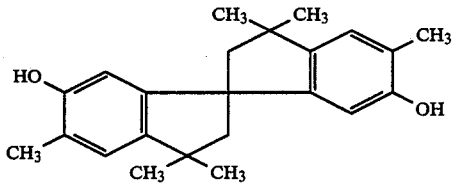

The phonol- or phenylether-type compounds represented by the Formula IV should be used in an amount within the range of, preferably, from $1\times10^{-2}$ to 5 mol per mol of the magenta couplers of the invention used and more preferably, from $1\times10^{-1}$ to 2 mol.

The silver halide photographic light-sensitive materials of the invention can be not only of the black-and-white type but also of either monocolor or multicolor type which include, for example, color films of either the negative or positive type, color print papers and so forth. In the case of the multicolor silver halide photographic light-sensitive materials, they usually have a structure comprising a support laminated thereon with both silver halide emulsion layers respectively containing magenta, yellow and cyan couplers serving as the photographic couplers and non-light-sensitive layers, in suitable arrangement order and in suitable number, so that a color reproduction can be performed in a color subtraction method. It is, however, allowed to change the number of layers and the arrangement order thereof so as to suitably meet the desired characteristics and the purposes of the use.

There shall be no special limitation to the silver halide composition of the light-sensitive silver halide grains which are to be used in the invention, but anyone of silver chloride, silver bromide, silver iodide, silver chlorobromide, silver iodobromide and silver chloroiodobromide may be used. Further, the mixture of these grains may also be used. However, from the viewpoint of obtaining more remarkable effects relating to the invention, the silver halide grains which are to be used in the invention should have a silver chloride content of not less than 80 mol % and more preferably not less than 90 mol %, a silver bromide content of not more than 20 mol % and more preferably not more than 10 mol %, and a silver iodide content of not more than 0.5 mol %. Further preferably, the silver halide grains should be those of silver chlorobromide having a silver bromide content of from 0 to 5 mol % or silver chloride.

In the silver halide grains which may be used in the invention, the composition thereof may be either uniform from the inside of the grains through the outside thereof or different between the inside of the grains and the outside thereof. In the case where the composition of the inside of the grains is different from that of the outside thereof, the composition of the grains may be varied either continuously or intermittently.

There should be no special limitation to the grain sizes of the silver halide grains used in the invention though, the sizes should be preferably from 0.2 to 1.6 μm and more preferably from 0.25 to 1.2 μm, taking the other photographic characteristics such as rapid processability, sensitivity and so forth into consideration.

The above-mentioned grain sizes may be measured in a variety of measurement methods popularly used in the fields of the art. Typical methods are described in, for example, R. P. Loveland, 'Particle-Size Measurement', A.S.T.M. Symposium on Light Microscopy, 1955, p.122, 94; and C. E. K. Mees and T. H. James, 'The Theory of the Photographic Process', 3rd Ed., The Macmillan Co., 1966.

These grain sizes may be measured in terms of either the projective area of a grain or a direct approximation thereof.

In the case that the forms of grains are substantially uniform, the considerably precise grain distribution may be expressed in terms of the diameter or the projective area.

In the silver halide grains relating to the invention, the grain size distribution may be of either polydisperse type or monodisperse type. However, a preferable emulsion grains should be of the monodisperse type. More preferable grains should be those of the monodisperse type having a variation coefficient of not more than 0.22 in grain size distribution and, further preferably, not more than 0.15.

The term, a variation coefficient, used herein means a coefficient indicating the broadness of grain size distribution, which can be defined as the following formula.

$$\text{Variation coefficient } (S/r) = \frac{\text{Standard deviation of grain size distribution}}{\text{Average grain size}}$$

wherein $S$ = Standard deviation of grain size distribution $$S = \sqrt{\frac{\Sigma (r - ri)^2\, ni}{\Sigma ni}}$$

$$\text{Average grain size } (r) = \frac{\Sigma niri}{\Sigma ni}$$

ri represents the grain size of an individual grain;

ni represents the number of the individual grains; and the term, 'grain size', stated herein means the diameter of a silver halide grain, when the grain is globular shaped; and the diameter obtained by converting the projective image of a silver halide grain into a circular image having the same areas, when the grain is cubic shaped or in the other shaped than the globular shaped.

The silver halide grains which are to be used in the silver halide emulsions of the invention may be those prepared in any method selected from an acidic method, a neutral method and an ammoniacal method. These grains are allowed to be grown either at one time or after seed grains are produced. The methods for producing the seed grains and that for growing them may be the same with or the different from each other.

For preparing a silver halide emulsion, it is allowed to mix halide ions and silver ions at the same time or to mix either one in the other already present. It is also allowed to grow the grains in such a manner that the halide ions and silver ions are added gradually at the same time while taking the critical growth rate of silver halide crystals into consideration and controlling the pH and pAg values inside a mixing vessel. It is further allowed to change the halogen composition of the grains in a conversion method, after the grains are grown up.

In the course of preparing the silver halide emulsion of the invention, the size, configuration, size distribution and growth rate of the silver halide grains thereof may be controlled by making use of a silver halide solvent, if occasion demands.

After completing the growth of silver halide grains, any unnecessary soluble salts may be either removed from the silver halide emulsions of the invention or contained therein as they are. If the salts are to be removed, it may be carried out in such a method as mentioned in Research Disclosure, No. 17643.

The silver halide grains used in the silver halide emulsions of the invention may be comprised of a layer of which the inside and surface are either uniform with or different from each other.

The silver halide grains used in the silver halide emulsions of the invention may be those capable of forming a latent image mainly either on the surface thereof or inside the grains.

The silver halide grains used in the silver halide emulsions of the invention may be either in the regular crystal form or in the irregular crystal forms such as a globular and tabular forms. In these grains, {100} planes and {111} planes may be used in any ratios. Also, these grains may be either in the form of a crystal complex or in the form of a mixture of variously crystallized grains.

The silver halide emulsions of the invention may be used in the form of the mixture of two or more kinds of silver halide emulsions separately prepared.

The silver halide emulsions of the invention may be chemically sensitized in any one of ordinary methods, namely, a sulfur sensitization method in which a compound containing sulfur capable of reacting with silver ions, active gelatin and so forth are used; a selenium sensitization method in which a selenium compound is used; a reduction sensitization method in which a reducible substance is used; a noble metal sensitization method in which gold or the other noble metal compounds are used; and so forth. These methods may be used independently or in combination. Among the methods, the sulfur sensitization method and the gold sensitization method should preferably be used and, more preferably, the combination of the sulfur sensitization and the gold sensitization should be used.

In the invention, a chemical sensitizer such as a chalcogen sensitizer may be used. The word, 'chalcogen sensitizer', is a generic name of sulfur sensitizers, selenium sensitizers and tellurium sensitizers. Among these sensitizers, the sulfur sensitizers and selenium sensitizers should be preferable for photographic use. As for the sulfur sensitizers, any well known ones may be used. They include, for example, a thiosulfate, allylthiocarbazide, thiourea, allylisothiocyanate, cystine, a p-toluenethiosulfonate, rhodanine, and so forth. Besides the above, it is also allowed to use the sulfur sensitizers described in U.S. Pat. Nos. 1,574,944, 2,410,689, 2,278,947, 2,728,668, 3,501,313 and 3,656,955; West German Patent (OLS) No. 4,422,869; Japanese Patent O.P.I. Publication Nos. 24937-1981 and 45016-1980; and so forth. The amount of such a sulfur sensitizer to be added may be considerably varied according to various conditions such as pH, temperature, silver halide grain size and so forth. It should, however, be preferable to add in an amount of, roughly, the order of from $10^{-7}$ mol to $10^{-1}$ mol per mol of silver halides used.

The sulfur sensitizers may be replaced by any one of the selenium sensitizers including, for example, such an aliphatic isoselenocyanate as allylisoselenocyanate; a selenourea; a selenoketone; a selenoamide; a selenocarboxylate and the esters thereof; a selenophosphate; such a selenide as diethyl selenide, diethyl doselenide and so forth. The typical examples thereof are given in U.S. Pat. Nos. 1,574,944, 1,602,592 and 1,623,499; and so forth. Further, a reduction sensitization may also be used in combination. There is no special limitation to the reduction sensitizers, but they include, for example, stannous chloride, thiourea dioxide, hydrazine, polyamine and so forth, which are well known. Besides the above, noble metal compounds such as a platinum compound, palladium compound and so forth may also be used for.

It is preferable that the silver halide grains relating to the invention contain a gold compound. The gold compounds which should preferably be used in the invention include a variety of gold compounds having gold oxidation number of either + monovalency or + tervalency.

The typical examples thereof include chloroaurate, potassium chloroaurate, auricrichloride, potassium auricthiocyanate, potassium iodoaurate, tetracyanoauricazide, ammonium aurothiocyanate, pyridyl trichlorogold, gold sulfide, gold selenide and so forth.

The gold compounds may be used either to sensitize silver halide grains or not to substantially contribute to the sensitization.

The amount of the gold compounds added depends on various conditions, however, they should be added roughly in an amount of from $10^{-8}$ mol to $10^{-1}$ mol per mol of silver halides used and, more preferably, from $10^{-7}$ mol to $10^{-2}$ mol. And, these compounds may be added in any of the steps where silver halide grains are formed, physically ripened and chemically ripened or thereafter.

It is preferable that the silver halide emulsions of the invention should be optically sensitized to a desired wavelength region by making use of a dye which is well known as a sensitizing dye in the photographic art. Such a sensitizing dye may be used either independently or in combination. An emulsion is also allowed to contain a sensitizing dye and, besides and together with the sensitizing dye, a supersensitizer capable of enhancing the sensitizing action of a sensitizing dye, which is either a dye not having any spectral sensitizing function in itself or a compound not substantially absorbing any visible rays of light.

With the purposes of preventing a light-sensitive material from producing fog in the courses of preparing, preserving or photographically processing the light-sensitive material and/or keeping the stability of the photographic characteristics of the light-sensitive material, a compound which is well known in the photographic art as an antifoggant or a stabilizer may be added in the silver halide emulsions of the invention in the courses that a chemical ripening is carried out and/or at the time of completing the chemical ripening and/or at a point of time between the time when the chemical ripening is completed and the time when the silver halide emulsion is coated on.

As for this kind of compounds, the compounds represented by the following Formula S should preferably be used.

Formula S

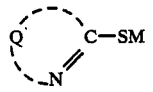

wherein Q represents a group of atoms necessary to complete a 5- or 6-membered heterocyclic ring or a 5- or 6-membered heterocyclic ring into which a benzene ring is condensed; and M represents a hydrogen atom, an alkali metal atom such as that of sodium, potassium or the like, or an ammonium group.

In Formula S, Q represents a group of atoms necessary to complete a 5- or 6-membered heterocyclic ring or a 5- or 6-membered heterocyclic ring into which a benzene ring is condensed. The 5-membered heterocyclic rings formed by Q include, for example, each ring of imidazole, tetrazole, thiazole, oxazole, selenazole, benzoimidazole, naphthoimidazole, benzothiazole, naphthothiazole, benzoselenazole, naphthoselenazole, benzoxazole and so forth. The 6-membered heterocyclic rings formed by Q include, for example, each ring of pyridine, pyrimidine, quinoline and so forth. These 5- or 6-membered heterocyclic rings include those having substituents.

The mercapto compounds represented by Formula S may particularly be represented by the following Formula SA or SB.

Formula SA

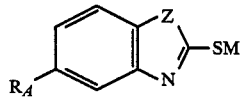

wherein $R_A$ represents an atom of hydrogen or halogen, a group of alkyl, alkoxy, aryl or amino, a carboxyl group or the salts thereof, or a sulfo group or the salts thereof; Z represents —NH—, —O— or —S—; and M is synonymous with M denoted in formula S.

Formula SB

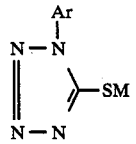

wherein Ar represents

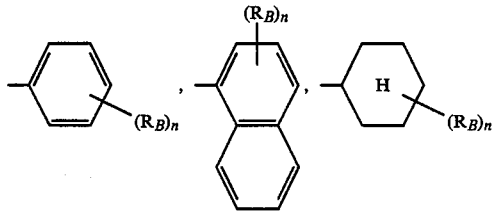

$R_B$ represents a group of alkyl, alkoxy, hydroxyl, amino, acylamino, carbamoyl or sulfonamido, a carboxyl group or the salts thereof, or a sulfo group or the salts thereof; n is an integer of 0 to 2; and M is synonymous with M denoted in Formula S.

In the above-given Formulas SA and SB, the groups of alkyl, alkoxy, aryl, amino, acylamino, carbamoyl and sulfonamido each include those having substituents, respectively.

The concrete examples of the compounds represented by Formula S will be given below. It is, however, to be understood that the invention shall not be limited thereto.

S-1

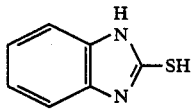

S-2

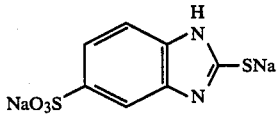

S-3

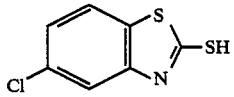

S-4

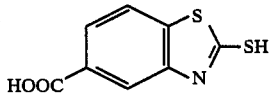

S-5

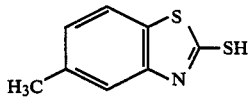

S-6

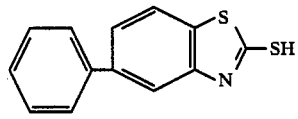

S-7

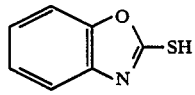

S-8

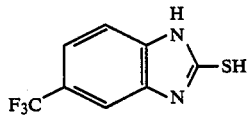

S-9

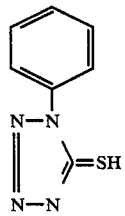

-continued

S-10

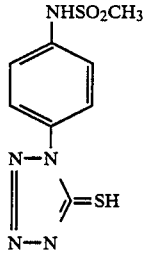

S-11

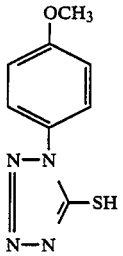

S-12

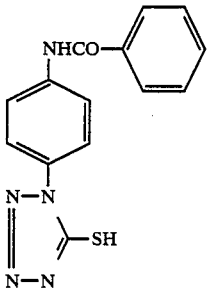

S-13

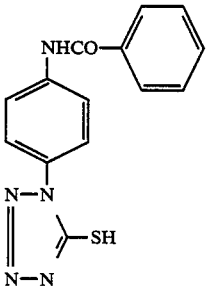

S-14

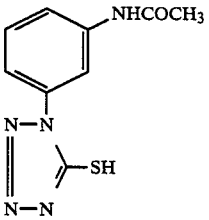

S-15

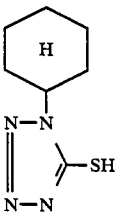

-continued

SB-16

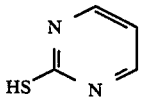

SB-17

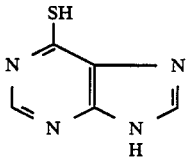

SB-18

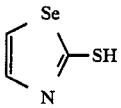

SB-19

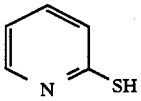

SB-20

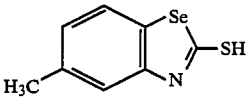

The compounds represented by the aforegiven Formula S include those described in, for example, Japanese Patent Examined Publication No. 28496-1965; Japanese Patent O.P.I. Publication No. 89034-1975; Journal of Chemical Society, 49, 1748 (1927), 4237 (1952); Journal of Organic Chemistry, 39, 2469 (1965); U.S. Pat. No. 2,824,001; Journal of Chemical Society, 1723 (1951); Japanese Patent O.P.I. Publication No. 111846-1981; British Pat. No. 1,275,701; U.S. Pat. Nos. 3,266,897 and 2,403,927; and so forth. These compounds may be synthesized in accordance with the synthesizing methods described in the above-given literatures.

The compounds which are relative to the invention and represented by Formula S will be hereinafter referred to as Compounds S. Now, Compound S may be added in a silver halide emulsion layer containing the silver halide grains relating to the invention upon dissolving Compound S in either water or an organic solvent such as methanol, ethanol or the like which is freely miscible with water. Compounds S may be used independently, in combination thereof, or in combination with other stabilizer or antifoggant than Compounds S.

Compounds S may be added at any point of time before or during the formation of silver halide grains, between a time when the silver halide grains are completed and a time when a chemical ripening is commenced, during the chemical ripening, when the chemical ripening is completed, or between a time when the chemical ripening is completed and a time when the resulting emulsion is coated on. It should be preferred to add Compounds S at a point of time during the chemical ripening, at a point of time when the chemical ripening is completed, or a point of time between a time when the chemical ripening is completed and a time when the emulsion is coated on.

Compounds S may be added either in the whole amount at a time or by dividing the whole amount into several parts.

Compounds S may be added directly into a silver halide emulsion or a silver halide emulsion coating solution, or may be added first into a coating liquid for a non-light-sensitive hydrophilic colloidal layeradjacent to the silver halide emulsion layer relating to the invention, so that Compounds S may be contained in the silver halide emulsion layer relating to the invention by the diffusion produced in a multilayer coating step.

There is no special limitation to the amounts added. It is, however, usual to add Compounds S in an amount of from $1\times10^{-6}$ mol to $1\times10^{-1}$ mol per mol of silver halide used and, more preferably, from $1\times10^{-5}$ mol to $1\times10^{-2}$ mol.

Gelatin is advatageous to serve as the binder (or a protective colloid) of the silver halide emulsion of the invention. Besides gelatin, a hydrophilic colloids including, for example, a gelatin derivative, a graft polymer of gelatin and other high molecules, protein, a sugar derivative, a cellulose derivative, such a synthetic hydrophilic high molecular substance as a monomer and a copolymer.

In a light-sensitive material containing the silver halide emulsions of the invention, the photographic emulsion layers and the other hydrophilic colloidal layers thereof may be hardened by making use of a hardener independently or in combination which is capable of cross-linking the molecules of a binder or a protective colloid to enhance the strength of the layers. Such hardeners may desirably be added in such an amount as is not necessary to add a further hardener into a processing solution but capable of harden a light-sensitive material. It is, however, allowed to add hardeners into processing solutions.

In a light-sensitive material containing the silver halide emulsions of the invention, a plasticizer may be added with the purpose of increasing the pliability of the silver halide emulsion layers and/or the other hydrophilic colloidal layers thereof.

In a light-sensitive material containing the silver halide emulsions of the invention and/or another hydrophilic colloidal layer, the dispersion, or the latex, of a water-insoluble or hardly soluble synthetic polymer may be added with the purpose of improving dimensional stability or the like.

In the emulsion layers of the silver halide color photographic light-sensitive materials of the invention, it is allowed to use a dye forming coupler capable of forming a dye upon reaction with the oxidized product of an aromatic primary amine developing agent such as a p-phenylenediamine derivative or an aminophenol derivative.

It is usual to select each of the above-mentioned dye forming couplers and add them into an emulsion layer so as to form the dyes capable of absorbing the same specific photospectral rays of light to which a specific emulsion layer is sensitive. Namely, yellow dye forming couplers are to be added into a blue light-sensitive emulsion layer, magenta dye forming couplers into a green light-sensitive emulsion layer and cyan dye forming couplers into a red light-sensitive emulsion layer, respectively. It is, however, allowed to prepare a silver halide color photographic light-sensitive material in the different combinations and methods from the above, so as to meet the various purposes.

The yellow dye forming couplers include, for example, acylacetamide couplers such as those of a benzoylacetanilide or a pivaloylacetanilide; the magenta dye forming couplers include, besides the couplers of the invention, 5-pyrazolone couplers, pyrazolobenzimidazole couplers, pyrazolotriazole couplers and open-chained acylacetonitrile couplers, for example; and the cyan dye forming couplers include, for example, those of the phenyl and naphthol types and so forth.

Among the dye image forming couplers which may be used in the invention, the typical yellow dye forming couplers and cyan dye forming couplers will be given below.

Yellow Dye Forming Couplers

Y-1

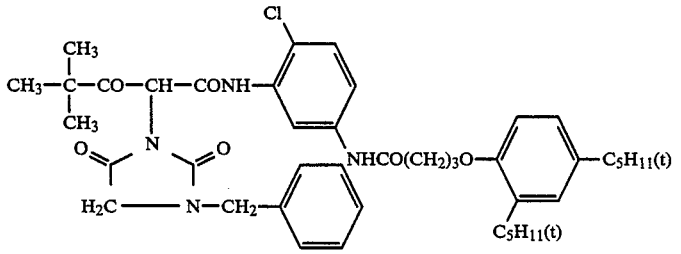

Y-2

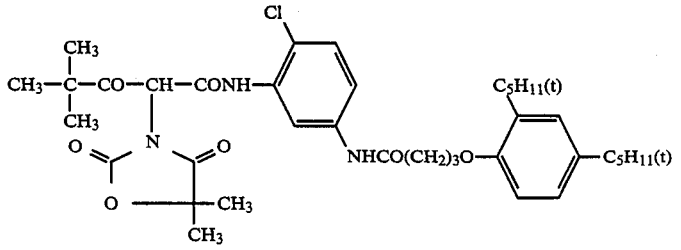

-continued
Y-3
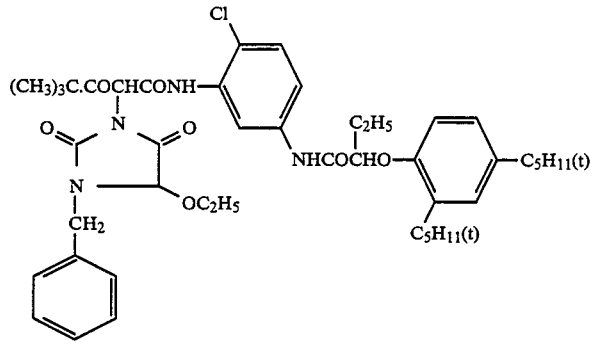
Y-4
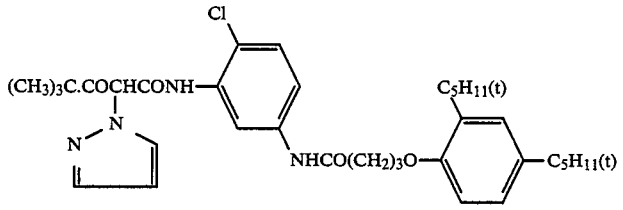
Y-5
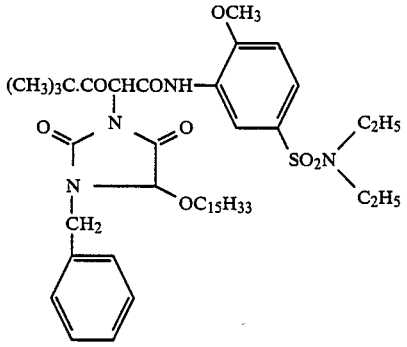
Y-6
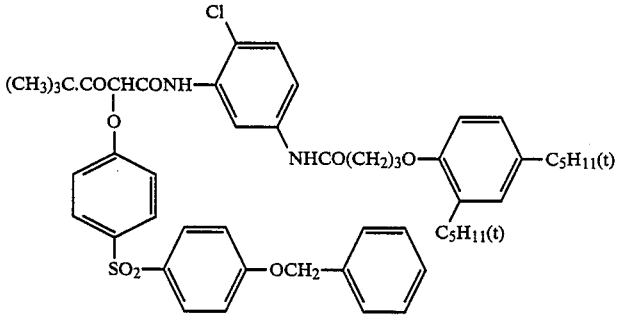
Y-7)
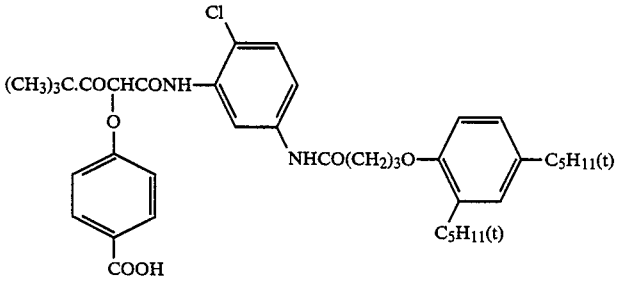

-continued
Y-8
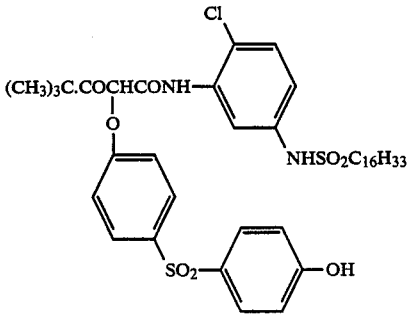
Y-9
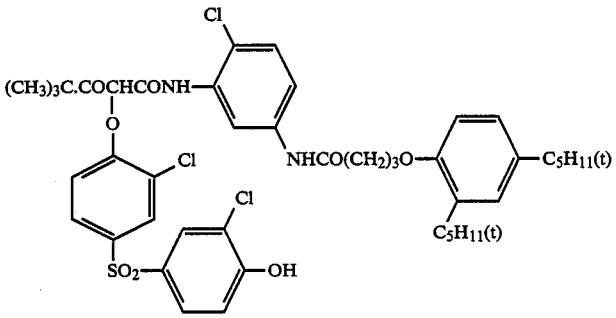
Y-10
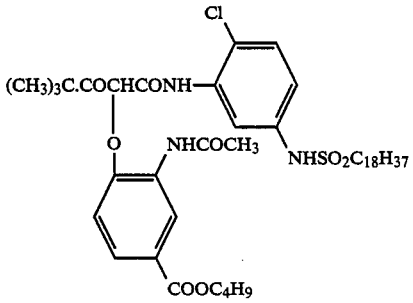
Y-11
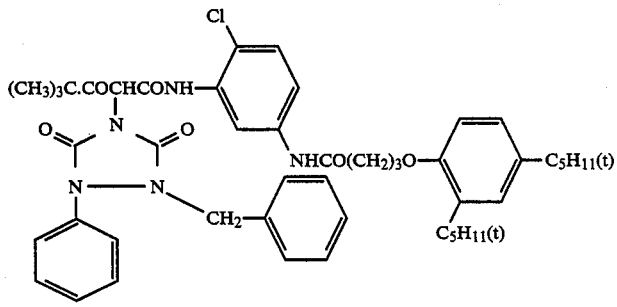

-continued

Y-12

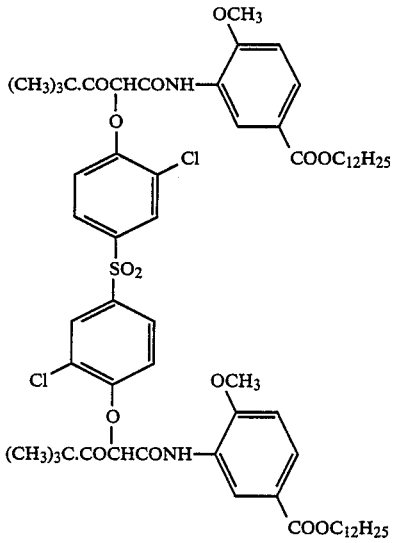

Y-13

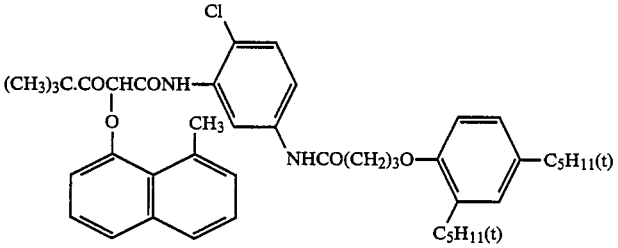

Y-14

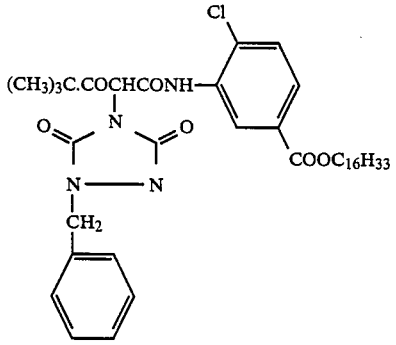

Y-15

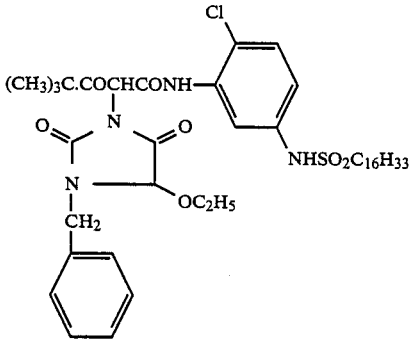

The yellow dye forming couplers are described in, for example, West German Patent OLS Nos. 2,057,941 and 2,163,812; Japanese Patent O.P.I. Publication Nos. 26133-1972, 29432-1973, 65231-1975, 3631-1976, 50734-1976, 102636-1976, 33410-1976, 66835-1973, 94432–1973, 1229–1974 and 10736–1974; and Japanese Patent Examined Publication No. 25733-1977.

The magenta dye forming couplers include, besides the couplers of the invention, 5-pyrazolone couplers, pyrazolobenzimidazole couplers, pyrazolotriazole couplers and open-chained acylacetonitrile couplers, for example; and the cyan dye forming couplers include, for example, those of the phenyl and naphthol types and so forth. To be more concrete, they include the following compounds.
Cyan Dye Forming Couplers
C-1
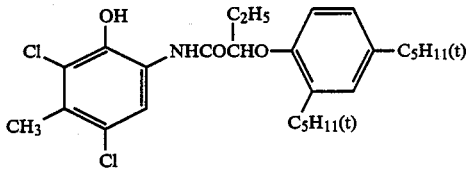
C-2
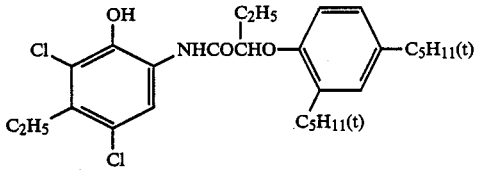
C-3
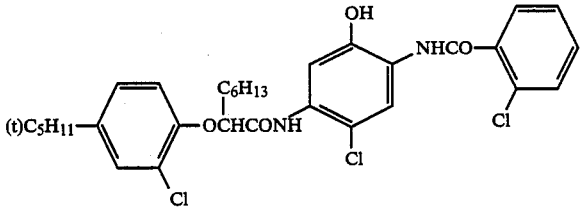
C-4
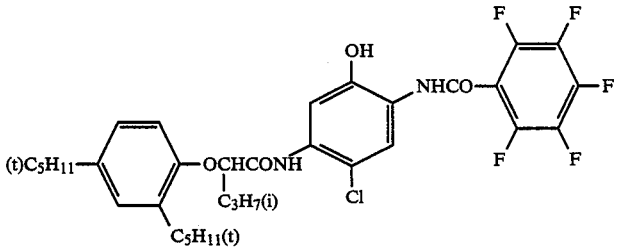
C-5
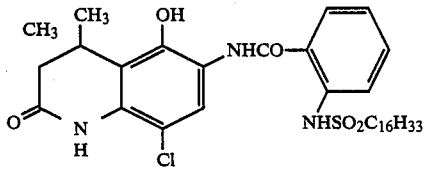
C-6
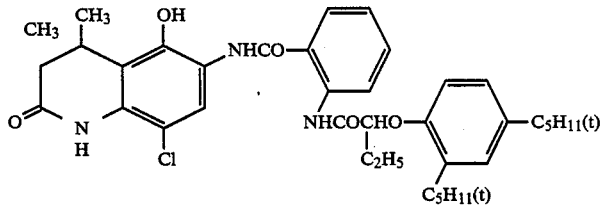
C-7
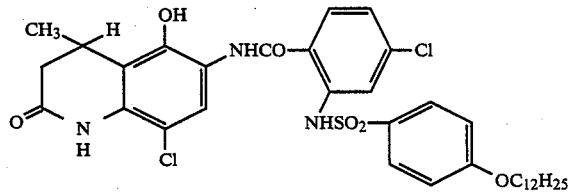

-continued

C-8

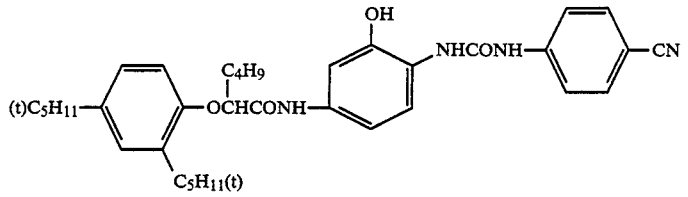

C-9

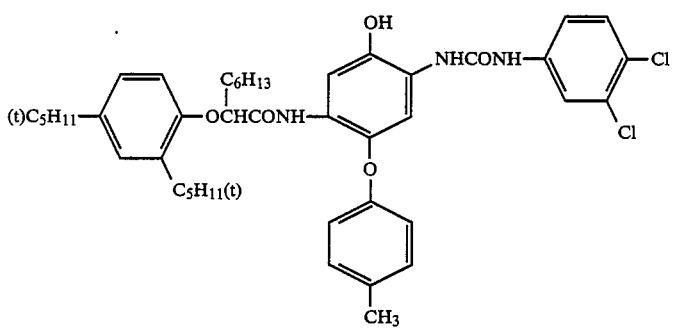

C-10

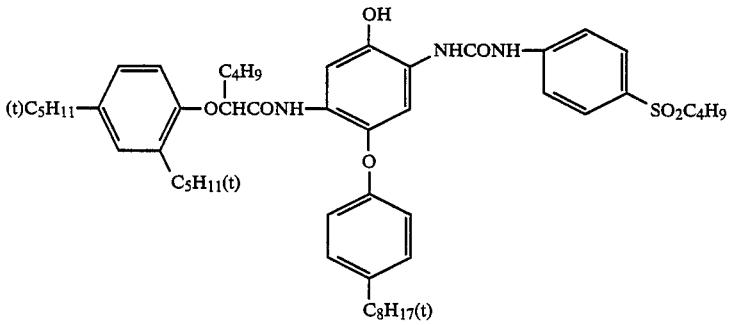

Besides the above, the cyan dye forming couplers which may be used in the invention include, typically, 4- or 2-equivalent type cyan dye forming phenol or naphthol couplers. The concrete examples thereof are given in, for example, U.S. Pat. Nos. 2,306,410, 2,356,475, 2,362,598, 2,367,531, 2,369,929, 2,423,730, 2,474,293, 2,476,008, 2,498,466, 2,545,687, 2,728,660, 2,772,162, 2,895.826. 2,976,146, 3,002,836, 3,419,390, 3,446,622, 3,476,563, 3,737,316, 3,758,308 and 3,839,044; British Pat. Nos. 478,991, 945,542, 1,084,480, 1,377,233, 1,388,024 and 1,543,040; and Japanese Patent O.P.I. Publication Nos. 37425-1972, 10135-1975, 25228-1975, 112038-1975, 117422-1975, 130441-1975, 6551-1976, 37647-1976, 52828-1976, 108841-1976, 109630-1978, 48237-1979, 66129-1979, 131931-1979 and 32071-1980.

Each of the couplers of the invention may be used in an amount of, usually, from $1\times10^{-3}$ mol to 1 mol per mol of silver halide used and preferably, from $1\times10^{-2}$ mol to $8\times10^{-1}$ mol.

These dye forming couplers desirably contain, in the molecules thereof, a so-called ballast group which does not diffuse any coupler and had not less than eight carbon atoms. These dye forming couplers may be either those of 4-equivalent type in which four silver ions are to be reduced to form a dye in each molecule or those of 2-equivalent type in which two silver ions may only be reduced.

In the color photographic light-sensitive materials of the invention, a color fog inhibitor is used so as to prevent a sharpness deterioration, a rough graininess and a color contamination caused by the migration of the oxidized products of a developing agent or an electron-transferring agent between the emulsion layers, i.e., between the same color sensitive layers and/or between the different color sensitive layers.

Such a color fog inhibitor may be used in either the emulsion layers in themselves or an interlayer interposed between the adjacent emulsion layers.

In the color light-sensitive materials containing the silver halide emulsions of the invention, an image stabilizer capable of preventing a dye image deterioration.

In the light-sensitive materials of the invention, the hydrophilic colloidal layers such as a protective layer, interlayer or the like are also allowed to contain a UV absorbing agent for the purposes of preventing fog caused by a discharge of electrification generated by the friction of light-sensitive materials with each other and so forth and preventing an image deterioration caused by illuminating with UV rays.

To the color light-sensitive materials containing the silver halide emulsions of the invention, such an auxiliary layers as a filter layer, an antihalation layer and/or an antiirradiation layer and so forth may be provided. These layers and/or emulsion layers may also contain a dyestuff capable of fluxing out of the light-sensitive material or being bleached in the course of carrying out a developing process.

In the silver halide light-sensitive materials containing the silver halide emulsions of the invention, a matting agent may be added into the silver halide emulsion layers and/or the other hydrophilic colloidal layers thereof for the purposes of, for example, improving retouchability to decrease the gross of the light-sensitive materials and to prevent stcking light-sensitive materials with each other.

In the light-sensitive materials containing the silver halide emulsions of the invention, a lubricant may also be added to reduce the sliding friction of the light-sensitive materials.

In the light-sensitive materials containing the silver halide emulsions of the invention, an antistatic agent may be added for preventing a possible charge. Such antistatic agents may be used, on one occasion, in an antistatic layer provided to one support side where no emulsion is coated and, on another occasion, in the emulsion layers and/or a protective layer on the support side where the emulsion layers are coated.

In the light-sensitive materials containing the silver halide emulsions of the invention, a variety of surface active agents may be used in the photographic emulsion layers and/or the other hydrophilic colloidal layers thereof with the purposes of improving coatability, preventing static charge, improving slidability, improving emulsification dispersion property, preventing adhesion, improving photographic characteristics such as development accelerating property, hardening property, sensitizing property and so forth.

In the light-sensitive materials containing the silver halide emulsions of the invention, the photographic emulsion layers and the other layers thereof may be coated on such a flexible reflective support such as, a paper laminated with baryta, $\alpha$-olefin polymer or the like or a synthetic paper, such a film as is made of semi-synthetic or synthetic macromolecules including cellulose acetate, cellulose nitrate, polystyrene, polyvinyl chloride, polyethyleneterephthalate, polycarbonate, polyamide and so forth, such a solid matter as glass, metal and earthware, and so forth.

The silver halide emulsions of the invention may be coated on a support, after the surface of the support is treated with a corona discharge, a UV irradiation, a flame treatment or the like itf required, directly or through one or more subbing layers capable of improving the adhesiveness to the surface of the support, static preventing property, dimensional stability, abrasion resistance, hardness, antihalation property, frictional property and/or the other properties.

In the coating process of the photographic light-sensitive material containing the silver halide emulsions of the invention, a thickening agent may be used to improve the coatability. The particularly useful coating methods include, for example, an extrusion coating method and a curtain coating method each capable of coating two or more layers at the same time.

The light-sensitive materials of the invention may be exposed to light by making use of electromagnetic waves in a spectral region to which the emulsion layers of the light-sensitive material are sensitive. As for the light sources, any of the well known light sources may be used, for example, natural light, i.e., daylight, a tungsten lamp, a fluorescent lamp, a mercury lamp, a Xenon-arc lamp, a carbon-arc lamp, a Xenon-flash lamp, a cathode ray tube, a flying-spot, a variety of laser beams, a light emitting device, light emitted from a fluorescent substance excited by electron beam, X rays, $\gamma$ rays or the like.

An exposure can be made not only for a time shorter than one microsecond, for example, an exposure time from 100 microseconds to one microsecond by making use of a cathode ray tube or a Xenon flash lamp, but also for a time longer than not shorter than one second, not to mention an exposure time from one millisecond to one second for which exposed to light with an ordinary type camera. Such exposure may be made continuously or intermittently.

With the silver halide photographic light-sensitive materials of the invention, an image can be formed in any color developing processes which are well known in the art.

In the invention, the aromatic primary amine color developing agents which may be used in color developers include well known ones which have popularly been used in a variety of color photographic processes. These developing agents include, for example, the aminophenol type and p-phenylenediamine type derivatives. These compounds are generally used in the form of salts such as a hydrochloride or a sulfate, because the salts are more stable than in free state. These compounds may be used in a concentration of, usually, from about 0.1 g to about 30 g per liter of a color developer used and, more preferably, from about 1 g to about 15 g per liter of the color developer.

The aminophenol type develoing agents include, for example, o-aminophenol, p-aminophenol, 5-amino-2-oxytoluene, 2-amino-3-oxytoluene, 2-oxy-3-amino-1,4-dimethylbenzene and so forth.

A particularly useful aromatic primary amine type color developing agent is a N,N'-dialkyl-p-phenylenediamine type compound in which the alkyl and phenyl groups may be substituted with any substituents. Among these compounds, the particularly useful compounds include, for example, an, N,N'diethyl-p-phenylenediamine hydrochloride, an N-methyl-p-phenylenediamine hydrochloride, an N,N'-dimethyl-p-phenylenediamine hydrochloride, 2-amino-5-(N-ethyl-N-dodecylamino)-toluene, an N-ethyl-N-$\beta$-methanesulfonamidoethyl-3-methyl-4-aminoaniline sulfate, N-ethyl-N-$\beta$-hydroxyethylaminoaniline, 4-amino-3-methyl-N,N'-diethyl aniline, a 4-amino-N-(2-methoxyethyl)-N-ethyl-3-methylaniline-p-toluene sulfonate and so forth.

In to the color developers which may be used in the process of the invention, it is allowed to add any of a variety of components including, for example, alkalizing agents such as sodium hydroxide, sodium carbonate, potassium carbonate and so forth, an alkali-metal sulfite, an alkali-metal bisulfite, an alkali-metal thiocyanate, an alkali-metal halide, bezyl alcohol, a water-softener, a thickener and so forth, each of which has popularly been used in color developers, as well as the above-mentioned aromatic primary amine type color developing agents. The pH values of these color developers are generally not lower than 7 and, most popular, between about 10 and about 13. In this invention, a light-sensitive material is color-developed and is then treated with a processing solution having a fixing function. In the case that the processing solution having a fixing function is a fixer, a bleaching step is carried out in advance of the fixing step. As for the bleaching agents which may be used in this bleaching step, the metal complex salts of an organic acid may be used. Such metal complex salts are to have the functions that a metallic silver produced in a developing step is oxidized and restored to be a silver halide and, at the same time, that the portions of a dye forming coupler having not yet been colorless transformed to dye. These bleaching agents are structured by coordinating metal ions such as those of iron, cobalt, copper or the like with aminopolycarboxylic acid or an organic acid such as oxalic acid, citric acid or the like.

The most preferable organic acids which should be used to produce the metal complex salts of the above-mentioned orgranic acids include polycarboxylic acid or aminopolycarboxylic acid. These polycarboxylic acid or aminopolycarboxylic acid may be those of an alkali-metal salt, ammonium salt or water-soluble amine salt.

The typical examples thereof may be given as follows.

[1] Ethylenediaminetetraacetic acid,
[2] Nitrilotriacetic acid,
[3] Iminodiacetic acid,
[4] Disodium ethylenediaminetetracaetate,
[5] Tetra(trimethyl ammonium) ethylenediaminetetraacetate,
[6] Tetrasodium ethylenediaminetetraacetate, and
[7] Sodium nitrilotriacetate The bleaching agents applicable to the invention are also allowed to contain a variety of additives, as well as the above-mentioned metal complex salts of the organic acids serving as the bleaching agents. As for the additives, re-halogenating agents including, particularly, an alkali halide or an ammonium halide, such as potassium bromide, sodium bromide, sodium chloride, ammonium bromide and so forth, metal salts, and chelating agents, should preferably be contained. It is also allowed to add appropriately such a pH buffer as a borate, an oxalate, an acetate, a carbonate, a phosphate and so forth, and the substances such as alkyl amines, polyethylene oxides which have been well-known as the additive usually added in bleaching solutions.

In addition, a fixers and bleach-fixers are allowed to contain one or two or more kinds of pH buffers comprising a variety of salts including, for example, such a sulfite as ammonium sulfite, potassium sulfite, ammonium bisulfite, potassium bisulfite, sodium bisulfite, ammonium metabisulfite, potassium metabisulfite, sodium metabisulfite and so forth, boric acid, borax, acetic acid, and various kinds of salts such as sodium hydroxide, potassium hydroxide, sodium carbonate, potassium carbonate, sodium bisulfite, sodium bicarbonate, potassium bicarbonate, sodium acetate, ammonium hydroxide and so forth.

When carrying out the processing of the invention while a bleach-fixer replenisher is being replenished into a bleach-fixing solution or the bath thereof, a thiosulfate, thiocyanate, sulfite of the like may be contained in the bleach-fixing solution or the bath thereof, or these salts may be contained in the bleach-fixing replenisher in advance and the resulting replenisher may then be added to the processing solution. In this invention, if required, the air or oxygen may be blown into the bleach-fixing bath and the reservoir of the bleach-fixing replenisher so as to increase the activity of the bleach-fixer, or, such a suitable oxidizing agent as hydrogen peroxide, a bromate, a persulfate and so forth may suitably be added therein.

EXAMPLES

The examples of the invention will now be described below. It is, however, to be understood that the embodiments of the invention shall not be limited thereto.

EXAMPLE 1

A silver chlorobromide emulsion (having a silver chloride content of 20 mol %) was prepared in the manner that an aqueous solution of potassium bromide and potassium chloride and an aqueous solution of silver nitrate were mixed at the same time in an aqueous inert gelatin solution containing potassium chloride with stirring violently at 50° C. for 60 minutes. The pAg value was controlled to be 7 in the course of mixing the solutions and then a washing and a desalting were carried out in a precipitation method. The characteristics of the resulted silver chlorobromide emulsion were measured. The grains were of 0.8 μm in average grain size and 0.10 in variation coefficient.

The resulted silver chlorobromide grains are gold-sulfur sensitized and both of a green light-sensitive sensitizing dye and a stabilizer were then added thereto at the point of time when the chemical sensitization was completed, so that a green light-sensitive silver chlorobromide emulsion, i.e., Emulsion A, was prepared.

Next, a silver chlorobromide emulsion having an average grain size of 0.8 μm and a variation coefficient of 0.10 was prepared in the same manner as in Emulsion A, except that, 30 minutes after starting the addition of the aqueous solution of potassium bromide and potassium chloride and the aqueous solution of silver nitrate, $K_2IrCl_6$ was added in an amount of $2\times10^{-6}$ mol per mol of the silver halide used.

Further, a green light-sensitive silver chlorobromide emulsion, i.e., Emulsion B, was prepared from the above-mentioned emulsion in the same manner as in Emulsion A.

As for the sensitizing dye and stabilizer, the following compound were used.

Sensitizing Dye

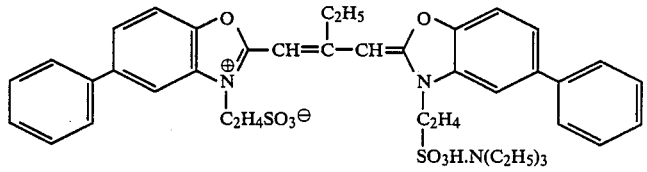

Stabilizer

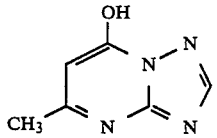

Then each of Emulsion A and B was divided several parts. Each parts of emulsions was added with sodium fluoro di0(2-ethylexyl)sulfosuccinate, the magenta coupler and HQ-6 as mention in Table 1 so that coating solutions was prepared.

The coating solutions were coated over resin-coated paper supports, respectively, with controlling the coating conditions so that the amount of silver coated may be 2 g/m² in terms of metal silver and the amount of gelatin coated may be 3 g/m². Further, gelatin of 1 g/m² was coated thereon to serve as a protective layer and was then dried. Thus, each of the samples was prepared.

Preparation of a Coupler Dispersion

Each coupler, a high boiling organic solvent, i.e., dioctyl phthalate, and ethyl acetate were added into an queous gelatin solution containing sodium dodecyl benzene sulfonate, so that a coupler dispersion was prepared. The above-mentioned sample thus prepared was exposed to green-light through a green optical wedge and was then processed in the following processing steps.

| Processing step | Processing temperature | Processing time |
|---|---|---|
| Color-developing | 32.8° C. | 3 min. 30 sec. |
| Bleach-fixing | 32.8° C. | 1 min. 30 sec. |
| Washing | 32.8° C. | 3 min. 30 sec. |

| Composition of color developer | |
|---|---|
| N—ethyl-N—β-methanesulfonamidoethyl-3-methyl-4-aminoaniline sulfate | 4.0 g |
| Hydroxylamine sulfate | 2.0 g |
| Potassium carbonate | 2.0 g |
| Sodium chloride | 0.1 g |
| Sodium bromide | 0.2 g |
| Sodium sulfite, anhydrous | 2.0 g |
| Benzyl alcohol | 10.0 ml |
| Polyethylene glycol (Average polymerization degree: 400) | 3.0 ml |
| Add water to make | 1 liter |
| Adjust pH with sodium hydroxide to be | pH 10.0 |
| **Composition of bleach-fixer** | |
| Ferric sodium ethylenediaminetetraacetate | 60.0 g |
| Sodium thiosulfate | 100.0 g |
| Sodium bisulfite | 20.0 g |
| Sodium metabisulfite | 5.0 g |
| Add water to make | 1 liter |
| Adjust pH with sulfuric acid to be | pH 7.0 |

With respect to each of the samples thus prepared, the gradient of the toe portion between density of 0.3 and that of 0.8 was measured by making use of an optical densitometer, Model PDA-60 manufactured by Konishiroku Photo Ind. Co., Ltd. Further, the light-resistance tests were tried to test the light-fastness in the following manner.

Light-Resistance Test

Each of the dye images formed on the samples was exposed to sunlight for 30 days by making use of a under-glass outdoor exposure table, through a UV absorbing filter so as to obtain the discoloration ratio, (Do-D)/(Do)×100, in which DO represents an initial density 1.0 and D represents a density obtained after a discoloration was produced.

TABLE 1

| Sample No. | AgX Emulsion | Gradient Hardening Agent | Magenta coupler | Toe gradient γ | Light-resistance Discoloration ratio % |
|---|---|---|---|---|---|
| 1 Comp. | A | — | Comp. coupler 1 | 1.78 | 60 |
| 2 Comp. | B | Ir | " | 1.83 | 62 |
| 3 Comp. | A | HQ-6 | " | 1.97 | 60 |
| 4 Comp. | A | — | Comp. coupler 2 | 1.55 | 58 |
| 5 Comp. | B | Ir | " | 1.66 | 57 |
| 6 Comp. | A | HQ-6 | " | 1.69 | 79 |
| 7 Comp. | A | — | Exempl. coupler 6 | 1.63 | 56 |
| 8 Inv. | B | Ir | " | 1.99 | 54 |
| 9 Comp. | A | HQ-6 | " | 1.83 | 78 |
| 10 Inv. | B | Ir | Exempl. coupler 7 | 2.00 | 55 |
| 11 Inv. | B | Ir | Exempl. coupler 9 | 1.98 | 54 |
| 12 Inv. | B | Ir | Exempl. coupler 13 | 2.05 | 54 |

As is obvious from Table 1, it is found in the invention to be able to obtain magenta images excellent in color reproducibility and in light-resistance, because the gradient in the toe portion is satisfactorily hard.

Comparative Magenta Coupler 1

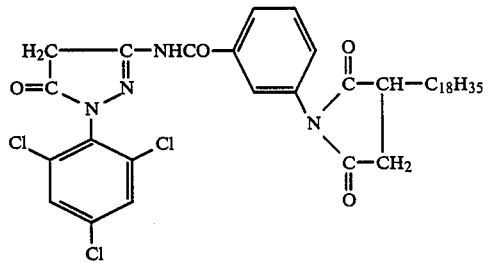

Comparative Magenta Coupler 2

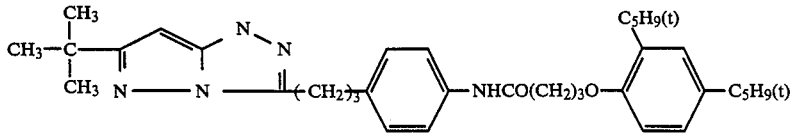

-continued

HQ-6

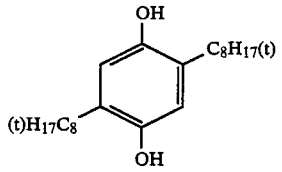

HQ-6 was added in an amount of 0.03 mol per mol of the coupler used.

EXAMPLE 2

Each of the following layers was coated on a polyethylene-laminated paper support having a titanium oxide content of 50 mg/dm$^2$, in order from the support side, so that a color light-sensitive material was prepared.

Layer 1: A Blue Light-Sensitive Emulsion Layer

This layer was coated with yellow coupler Y-1 in an amount coated of 8 mg/dm$^2$, a blue sensitive silver chlorobromide emulsion which had a silver chloride content of 20 mol % and a silver bromide content of 80 mol % and was prepared by mixing the emulsions each having the different grain sizes in an amount coated of 3 mg/dm$^2$ in terms of silver, a high boiling organic solvent, i.e., dinonyl phthalate or DNP, in an amount coated of 3 mg/dm$^2$, an anti-discoloring agent, (AO-1, in an amount coated of 4 mg/dm$^2$ and gelatin in an amount coated of 16 mg/dm$^2$.

Layer 2: An Interlayer

This layer was coated with Hydroquinone derivative 1, HQ-1, in an amount coated of 0.45 mg/dm$^2$ and gelatin in an amount coated of 4 mg/dm$^2$.

Layer 3: A Green Light-Sensitive Emulsion Layer

This layer was coated with magenta coupler in an amount coated of 4 mg/dm$^2$, a green-sensitive silver chlorobromide emulsion having a silver chloride content of 20 mol % and a silver bromide content of 80 mol % in an amount coated of 4 mg/dm$^2$ in terms of silver used, a high boiling organic solvent, dioctyl phthalate or DOP, in an amount coated of 4 mg/dm$^2$, an anti-discoloring agent, AO-2, containing a magenta-irradiation inhibitor in an amount coated of 4 mg/dm$^2$ and gelatin in an amount coated of 16 mg/dm$^2$.

Layer 4: An Interlayer

This layer was coated with two UV absorbents, UV-1 and UV-2, each in an amount coated of 3 mg/dm$^2$, respectively, DNP in an amount coated of 4 mg/dm$^2$, hydroquinone derivative 2, in an amount coated of 0.45 mg/dm$^2$, and gelatin in an amount coated of 14 mg/dm$^2$.

Layer 5: A Red Light-Sensitive Emulsion Layer

This layer was coated with two cyan couplers, C-2 and C-4, each in an amount coated of 2 mg/dm$^2$, a high boiling organic solvent, DOP, in an amount coated of 4 mg/dm$^2$, an anti-discoloring agent, AO-3, in an amount coated of 2 mg/dm$^2$, a red light-sensitive silver chlorobromide emulsion having a silver chloride content of 20 mol % and a silver bromide content of 80 mol % and containing a cyan-irradiation inhibitor in an amount coated of 3 mg/dm$^2$ in terms of silver used, and gelatin in an amount coated of 14 mg/dm$^2$.

Layer 6: An Interlayer

This layer was coated with a UV absorbent in an amount coated of 4 mg/dm$^2$, DNP in an amount coated of 2 mg/dm$^2$ and gelatin in an amount coated of 6 mg/dm$^2$.

Layer 7: A Protective Layer

This layer was coated with gelatin in an amount coated of 9 mg/dm$^2$ and DOP in an amount coated of 0.2 mg/dm$^2$. Wherein, a chlorotriazine type hardener was also used.

Compounds Used for Preparing the Samples

DNP: Dinonyl phthalate
DOP: Dioctyl phthalate
Hydroquinone derivative 1

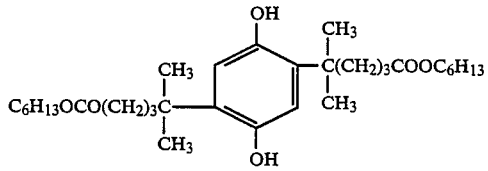

Hydroquinone derivative 2

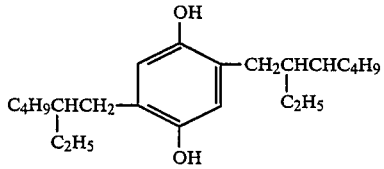

-continued

UV-1

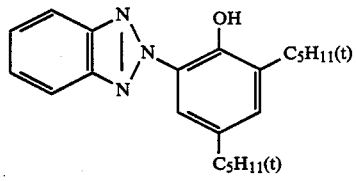

UV-2

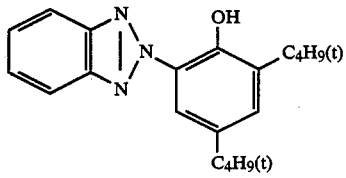

UV-3

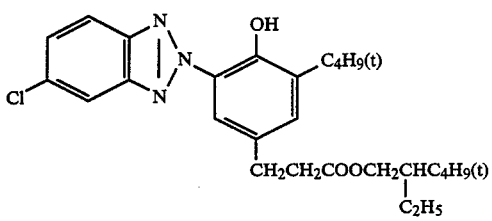

AO-1

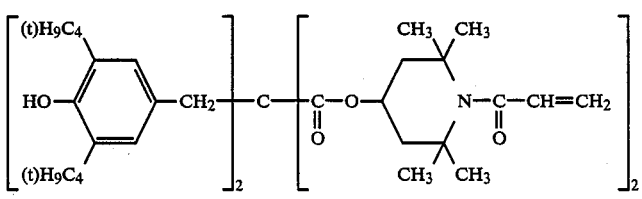

AO-2

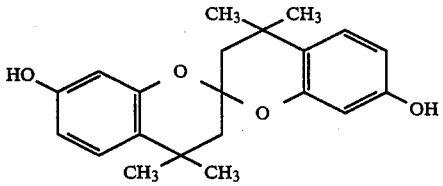

AO-3

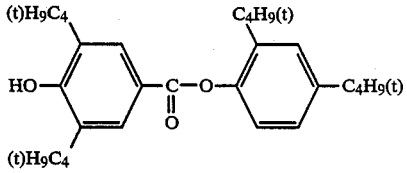

The silver halide emulsion and the coating solution thereof each for the gree-sensitive emulsion layer were prepared in the same manner as in Example 1.

The samples were prepared by changing the magenta couplers and the silver halide emulsions as indicated in Table 2.

These samples were exposed to light in the same manner as in Example 1. The gradients in the toe portions of the samples were measured, and the light-resistance of the samples were also tested.

For the purpose of investigating the color purity of the magenta color developed samples, the spectra of the spectral reflection densities of these samples were measured.

Measurements of the Spectra of the Spectral Reflection Densities of Magenta Color Developed Samples With respect to the magenta color developed portions of each sample, the spectral reflection spectra was measured by making use of a color analyzer Model 607 manufactured by Hitachi, Ltd. In these measurements, the maximum density of the absorption spectra in the visible regions of each sample was standardized as 1.0.

In each of the samples, the reflection density in 420 nm was regarded as the side absorption density so as to use as a guideline for color purity measurements.

The results thereof are shown in Table 2.

TABLE 2

| Sample No. | AgX Emulsion | Gradient Hardening Agent | Magenta coupler | Toe gradient γ | Light-resistance Discoloration ratio % | Color purity, Side absorption density |
|---|---|---|---|---|---|---|
| 13 Comp. | A | — | Comp. coupler 1 | 1.76 | 29 | 0.405 |
| 14 Comp. | B | Ir | " | 1.79 | 30 | 0.405 |
| 15 Comp. | A | HQ-6 | " | 1.88 | 29 | 0.407 |
| 16 Comp. | A | — | Comp. coupler 2 | 1.66 | 28 | 0.195 |
| 17 Comp. | B | Ir | " | 1.72 | 27 | 0.194 |
| 18 Comp. | A | HQ-6 | " | 1.53 | 38 | 0.196 |
| 19 Comp. | A | — | Exempl. coupler 6 | 1.73 | 28 | 0.194 |
| 20 Inv. | B | Ir | Exempl. coupler 6 | 2.11 | 27 | 0.194 |
| 21 Comp. | A | HQ-6 | " | 2.02 | 39 | 0.195 |
| 22 Inv. | B | Ir | Exempl. coupler 7 | 2.08 | 26 | 0.193 |
| 23 Inv. | B | Ir | Exempl. coupler 9 | 2.05 | 27 | 0.194 |
| 24 Inv. | B | Ir | Exempl. coupler 3 | 2.13 | 25 | 0.193 |

As is obvious from Table 2, it is found that, in the samples of the invention, not only both of the color purity and toe gradient are high but also the light-resistance can well be maintained, while in the comparative magenta coupler 2, the hardening effect is little in the toe portion.

EXAMPLE 3

Samples No. 25 through No. 36 which was the same as Examples No. 13 through No. 24 of Example 2 were prepared except that each of the silver halide emulsions used in Example 2 was replaced by silver chlorobromide having a silver chloride content of 99 mol %. The resulted samples were exposed to light in the same manner as in Example 1 and were then processed in the following processing steps.

| Processing step | Temperature | Time |
|---|---|---|
| Color developing | 34.7 ± 0.3° C. | 50 sec. |
| Bleach-fixing | 34.7 ± 0.5° C. | 50 sec. |
| Stabilizing | 30 to 34° C. | 90 sec. |
| Drying | 60 to 80° C. | 60 sec. |

Color developer

| | |
|---|---|
| Ethylene glycol | 10 ml |
| N,N—diethylhydroxylamine | 10 ml |
| Potassium chloride | 2 g |
| N—ethyl-N—β-methanesulfonamidoethyl-3-methyl-4-aminoaniline sulfate | 5 g |
| Sodium tetrapolyphosphate | 2 g |
| Potassium carbonate | 30 g |
| Fluorescent brightening agent, (a 4,4'-diaminostilbene sulfonic acid derivative) | 1 g |
| Add pure water to make total of | 1 liter |
| Adjust pH to be | pH 10.08 |

Bleach-fixer

| | |
|---|---|
| Ferric ammonium ethylenediamine-tetraacetate, dihydrate | 60 g |
| Ethylenediaminetetraacetic acid | 3 g |
| Ammonium thiosulfate (a 70% solution) | 100 ml |
| Ammonium sulfite (a 40% solution) | 27.5 ml |
| Adjust pH with potassium carbonate or glacial acetic acid to be | pH 7.1 |
| Add water to make total of | 1 liter |

Stabilizer

| | |
|---|---|
| 5-chloro-2-methyl-4-isothiazoline-3-one | 1 g |
| 1-hydroxyethylidene-1,1-diphosphoric acid | 2 g |
| Add water to make | 1 liter |
| Adjust pH with sulfuric acid or potassium hydroxide to be | pH 7.0 |

Samples No. 32 through No. 36 of the invention thus obtained were proved to be able to obtain sharp images which were excellent in the color reproduction of magenta images and capable of keeping both of light-resistance and toe gradient excellent.

EXAMPLE 4

Samples No. 37 through No. 41 which were equivalent to Sample No. 19 or No. 20 of Example 2 were prepared in the same manner, except that the compound represented by Formula III was added in the proportions each indicated in Table 3. Thus prepared samples were exposed to light in the same manner as in Example 2 and the toe gradient and light-resistance of each sample were measured. The results thereof are shown in Table 3.

TABLE 3

| Sample No. | AgX Emulsion | Compound III | Toe gradient | Light-resistance |
|---|---|---|---|---|
| 37 Comp. | A | — — | 1.73 | 28 |
| 38 Inv. | B (Ir) | — — | 2.11 | 27 |
| 39 Inv. | B (Ir) | HQ-33, 0.01 mol | 2.22 | 28 |
| 40 Inv. | B (Ir) | HQ-33, 0.02 mol | 2.75 | 29 |
| 41 Inv. | B (Ir) | HQ-33, 0.03 mol | 2.25 | 37 |

As is obvious from Table 3, with the silver halide photographic light-sensitive materials of the invention, the toe gradients and light-resistance can further be enhanced by adding the compounds represented by Formula III.

EXAMPLE 5

Samples which were the same as Sample No. 13 of Example 2 were prepared, except that the combinations of the magenta couplers and the water-soluble silver salts were changed as indicated in Table 4 and were then added into green-sensitive layers, respectively.

With respect to each of the samples thus prepared, the sensitivities and fog densities thereof were measured by making use of an optical densitometer. Further, with the purpose of testing the stability on standing, after each sample was allowed to stand at a temperature of 50° C. at a relative humidity of 80% for 72 hours and was then processed, the sensitivity and fog density of the processed samples were measured. The results thereof are shown in Table 4.

TABLE 4

| Sample No. | Coupler | Emulsion | Gradient Hardening Agent | Water-soluble silver salt, (mol/mol AgX) | Sample immediately after prepared: Sensitivity | Sample immediately after prepared: Fog density | Sample on standing: Sensitivity | Sample on standing: Fog density | Color purity, Side absorption density |
|---|---|---|---|---|---|---|---|---|---|
| 42 Comp. | M-2 | A | — | — | 102 | 0.06 | 58 | 0.14 | 0.204 |
| 43 Inv. | " | B | Ir | | 114 | 0.08 | 72 | 0.08 | 0.203 |
| 44 Inv. | " | B | Ir | Silver nitrate ($2 \times 10^{-2}$) | 113 | 0.05 | 89 | 0.07 | 0.203 |
| 45 Inv. | M-6 | B | Ir | " | 117 | 0.04 | 90 | 0.06 | 0.208 |
| 46 Inv. | M-7 | B | Ir | " | 113 | 0.04 | 90 | 0.06 | 0.203 |
| 47 Inv. | M-8 | B | Ir | " | 118 | 0.06 | 89 | 0.06 | 0.202 |
| 48 Inv. | M-13 | B | Ir | " | 119 | 0.06 | 89 | 0.08 | 0.203 |
| 49 Comp. | Comp. magenta coupler | A | — | — | 110 | 0.08 | 87 | 0.13 | 0.382 |
| 50 Comp. | " | B | Ir | Silver nitrate ($2 \times 10^{2}$) | 112 | 0.06 | 88 | 0.13 | 0.362 |

As is obvious from Table 4, with the samples of the invention, color images having an excellent color purity can be obtained.

Further, with the samples in which a water-soluble silver salt was jointly used, images having little fog increase and high sensitivity can be obtained even in the conditions where an aging deterioration was applied.

What is claimed is:

1. A silver halide photographic light-sensitive material comprising a support having thereon at least one silver halide emulsion layer containing at least one coupler represented by the the following Formula I and a water soluble iridium salt in an amount of from $10^{31\ 9}$ mol to $10^{-3}$ mol per mol of silver halide;

Formula I

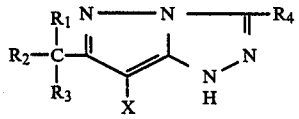

Formula I wherein X represents a halogen atom or a monovalent organic group capable of being split off upon coupling reaction with the oxidized product of a color developing agent;

$R_1$, $R_2$ and $R_3$ may be the same of different from each other and each represent a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a residue of spiro-compound, a residue of bridged hydrocarbon compound, an alkoxy group, an aryloxy group, a heterocyclic oxy group, a siloxy group, an acyloxy group, a carbamoyloxy group, an amino group, an acylamino group, a sulfonamido group, an imido group, an ureido group, a sulfamoylamino group, an alkoxycarbonylamino group, an aryloxycarbonyl amino group, an alkoxycarbonyl group, an alkylthio group, an aryloxycarbonyl group, an arylthio group or a heterocyclic thio group; and $R_4$ represents a hydrogen atom, an alkyl group, an aryl group, a heterocyclic group, an acylamino group, an alkylamino group, an anilino group, an alkoxycarbonyl group or an alkyl thio group; provided that at least one of $R_1$, $R_2$, $R_3$ and $R_4$ contains at least one group represented by the following Formula II;

Formula II $$-R_5-SO_2-R_6$$

wherein $R_5$ represents an alkylene group or an arylene group; and $R_6$ represents an alkyl group or an aryl group.

2. The material of claim 1, wherein an amount of said coupler contained in said silver halide emulsion layer is with in the range of from $1 \times 10^{-3}$ mol to 1 mol per mol of silver halide.

3. The material of claim 2, wherein an amount of said coupler contained in said silver halide emulsion layer is with in the range of from $1 \times 10^{-2}$ mol to $8 \times 10^{-1}$ mol per mol of silver halide.

4. The material of claim 1, wherein an amount of said water-soluble iridium salt is within the range of from $10^{-8}$ mol to $10^{-5}$ mol per mol of silver halide.

5. The material of claim 1, wherein said silver halide emulsion layer contains a compound represented by the following Formula III in an amount of from 0.001 mol to 0.025 mol per mol of said coupler contained said emulsion layer;

Formula III

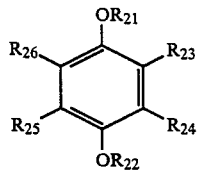

Formula III wherein $R_{21}$ and $R_{22}$ each represent a hydrogen atom, an alkyl group, an aklenyl group, an aryl group, an acyl group, a cycloalkyl group or a heterocyclic group; and $R_{23}$, $R_{24}$, $R_{25}$ and $R_{26}$ each represent a hydrogen atom, a halogen atom, an alkyl group, an alkenyl group, an aryl group, a cycloalkyl group, an alkoxy group, an aryloxy group, an alkyl thio group, an aryl thio group, an acyl group, an alkylacylamino group, an arylacylamino group, an alkylcarbamoyl group, an arylcarbamoyl group, alkylsulfonamido group, an arylsulfonamido group, an alkylsulfamoyl group, an arylsulfamoyl group, an alkylsufonyl group, an arylsulfonyl group, a nitro group, a cyano group, an alkyloxycarbonyl group, an aryloxycarbonyl group, an alkylacyloxy group or a arylacyloxy group; provided that, when $R_{23}$, $R_{24}$, $R_{25}$ and $R_{26}$ are hydrogen atoms at the same time, $R_{21}$ and $R_{22}$ shall not be hydrogen atom in the same time.

6. The material of claim 5, wherein an amount of said compound contained in said silver halide emulsion layer is within the range of from 0.005 to 0.02 mol per mol of said coupler.

7. The material of claim 1, wherein silver halide emulsion layer contains a water-soluble silver salt or a silver complex.

8. The material of claim 7, wherein said water-soluble silver salt or silver complex is one added to said silver halide emulsion at a point of time between the time when preparing of the coating solution of said silver halide emulsion and the time immediately before the coating of said silver halide emulsion.

9. The material of claim 7, said silver salt or silver complex is to be dissolved in water at 25° C. in an amount of not less than 1 g per litter of water.

10. The material of claim 9, said silver salt or silver complex is to be dissolved in water at 25° C. in an amount of not less than 3 g per litter of water.

11. The material of claim 7, wherein said silver salt is silver nitrite, silver nitrate, silver chlorate, silver perchlorate, silver sulfate, silver acetate, silver caproate, silver propionate, silver butyrate, silver valerate, silver isovalerate or silver $\alpha$-naphtoate.

12. The material of claim 7, wherein an amount of said water-soluble silver salt added to said silver halide emulsion layer is within the range of from $5\times10^{-5}$ mol to 0.3 mol per mol of silver halide.

13. The material of claim 12, wherein an amount of said water-soluble silver salt added to said silver halide emulsion layer is within the range of from $1\times10^{-4}$ mol to 0.1 mol per mol of silver halide.

14. The material of claim 1, wherein said silver halide emulsion layer comprises silver haide grains having a silver chloride content of not less than 80 mol %.

15. The material of claim 14, wherein said silver halide grains have a silver bromide content of not more than 10 mol %.

16. The material of claim 15, wherein said silver halide grains are a silver chlorobromide emulsion having a silver bromide content of from 0 to 5 mol % or a silver chloride.

* * * * *